US005219705A

United States Patent [19]

Kato et al.

[11] Patent Number: 5,219,705

[45] Date of Patent: Jun. 15, 1993

[54] LITHOGRAPHIC PRINTING PLATE PRECURSOR OF DIRECT IMAGE TYPE

[75] Inventors: Eiichi Kato; Kazuo Ishii, both of Shizuoka, Japan

[73] Assignee: Fuji Photo Film Co., Ltd., Kanagawa, Japan

[21] Appl. No.: 375,553

[22] Filed: Jul. 5, 1989

[30] Foreign Application Priority Data

Jul. 4, 1988 [JP] Japan ..... 63-165152
Jul. 4, 1988 [JP] Japan ..... 63-165153
Jul. 4, 1988 [JP] Japan ..... 63-165154

[51] Int. Cl.[5] ..... G03C 1/492
[52] U.S. Cl. ..... 430/270; 430/302
[58] Field of Search ..... 430/302, 270

[56] References Cited

U.S. PATENT DOCUMENTS 4,186,069 1/1980 Muzyczko et al. ..... 430/302
4,272,604 6/1981 Meador et al. ..... 430/302
4,288,520 9/1981 Sprintschnik et al. ..... 430/302
4,522,910 6/1985 Hallman ..... 430/168
4,568,628 2/1986 Eklund ..... 430/302
4,792,511 12/1988 Kato et al. .
4,828,952 5/1989 Kato et al. .
4,880,716 11/1989 Kato et al. .
4,897,328 1/1990 Kato et al. .
4,910,112 3/1990 Kato et al. .
4,929,526 5/1990 Kato et al. .
4,960,661 10/1990 Kato et al. .
4,971,870 11/1990 Kato et al. .
4,971,871 11/1990 Kato et al. .
4,977,049 12/1990 Kato .
4,996,121 2/1991 Kato et al. .
5,001,029 3/1991 Kato et al. .

*Primary Examiner*—Jack P. Brammer
*Attorney, Agent, or Firm*—Sughrue, Mion, Zinn, Macpeak & Seas

[57] ABSTRACT

A lithographic printing plate precursor of direct image type, adequately prevented from occurrence of background stains and having excellent printing durability is provided, comprising a base and an image receptive layer provided on the base, in which said image receptive layer contains at least one resin grains containing at least one functional group capable of producing at least one polar group through decomposition, optionally at least a part of the resin being crosslinked.

16 Claims, No Drawings

LITHOGRAPHIC PRINTING PLATE PRECURSOR OF DIRECT IMAGE TYPE

BACKGROUND OF THE INVENTION

1. Field of the Invention

This invention relates to a lithographic printing plate and more particularly, it is concerned with a lithographic printing plate precursor of direct imaging type, suitable for a printing plate precursor for an office work.

2. Description of the Prior Art

Lately, a lithographic printing plate of direct imaging type, having an image receptive layer on a base, has widely been used as a printing plate precursor for an office work. For carrying out plate making, i.e. imaging on such a printing plate, there have generally been employed a method comprising drawing an image with an oily ink by hand on an image receptive layer, or a method comprising printing it by means of a typewriter, ink jet system or transfer type thermosensible system. Furthermore, there has lately been proposed a method comprising subjecting a light-sensitive material to processings of statically charging, exposing and developing using an ordinary electrophotographic copying machine (plain paper copy machine, PPC), thus forming a toner image on the light-sensitive material and then transferring and fixing the toner image to an image receptive layer. In any case, a printing plate precursor after plate making is subjected to a surface treatment with an oil-desensitizing solution (so-called etching solution) to render a non-image area oil-desensitized and then applied to lithographic printing as a printing plate.

A lithographic printing plate of direct imaging type of the prior art generally comprises a base such as paper, a back layer provided on one side of the base and a surface layer, i.e. image receptive layer provided on the other side of the base through an interlayer. The back layer or interlayer is composed of a water-soluble resin such as PVA and starch, water-dispersible resin such as synthetic resin emulsions and pigment. The image receptive layer as a surface layer is composed of a pigment, water-soluble resin and water proofing agent.

A typical example of the lithographic printing plate precursor of direct imaging type is described in U.S. Pat. No. 2532865 in which the image receptive layer is composed of, as predominant components, a water-soluble resin binder such as PVA, an inorganic pigment such as silica or calcium carbonate and a waterproofing agent such as initial condensate of melamine-formaldehyde resin.

In the thus resulting printing plate of the prior art, however, there arises a problem that when the hydrophobic property is enhanced by increasing the amount of a waterproofing agent or by using a hydrophobic resin so as to improve the printing durability, the printing durability is improved, but the hydrophilic property is deteriorated to cause printing stains, and when the hydrophilic property is improved, the water-proofing property is deteriorated to lower the printing durability. At high temperatures, for example, 30° C. or higher, in particular, the surface layer (image receptive layer) is dissolved in dampening water used for offset printing, thus resulting in lowering of the printing durability and occurrence of printing stains. This is an important disadvantage.

In the lithographic printing plate, moreover, drawing or imaging is carried out using an oily ink as an image area on the image receptive layer, and unless the adhesiveness of this receptive layer and oily ink is good, the oily ink on the image area is separated during printing, thus resulting in lowering of the printing durability, even if the hydrophilic property of the non-image area is sufficient and the printing stains as described above do not occur.

SUMMARY OF THE INVENTION

It is an object of the present invention to provide a lithographic printing plate precursor of direct imaging type, whereby the disadvantages of the prior art, as described above, can be overcome.

It is another object of the present invention to provide a lithographic printing plate of direct imaging type, excellent in oil-desensitivity, whereby not only overall and uniform ground stains but also spot-like ground stains can be prevented when used as an offset master.

It is a further object of the present invention to provide a lithographic printing plate, in which the adhesiveness of an oily ink on an image area to an image receptive layer is improved and during printing, the hydrophilic property of a non-image area is sufficiently maintained even if the number of prints are increased, to thus prevent from occurrence of background stains and show a high printing durability.

These objects can be attained by a lithographic printing plate precursor of direct image type, comprising a base and an image receptive layer provided on the base, in which said image receptive layer contains at least one resin grains containing at least one functional group capable of producing at least one polar group through decomposition, optionally at least a part of the resin being crosslinked.

DETAILED DESCRIPTION OF THE INVENTION

In the present invention, the resin grains contained in the image receptive layer are subjected to hydrolysis or hydrogenolysis to form polar groups by an oil-desensitizing solution or dampening water during printing.

In the printing plate precursor or master of direct imaging type according to the present invention, therefore, the adhesiveness of the image receptive layer and an oily ink is rendered well by the action of lipophilic groups in the resin grains when drawing or imaging is carried out on the image receptive layer using the oily ink as an image area and thus the printing durability is improved.

In the printing plate of direct image type according to the present invention, on the other hand, on a non-image area, the resin grains are subjected to hydrolysis or hydrogenolysis to form polar groups by an oil-desensitizing solution or dampening water and thus rendered hydrophilic as described above, whereby this hydrophilic property can clearly be distinguished from the lipophilic property of an image area and a printing ink does not adhere to the non-image area during printing.

In the prior art, imaging with an oily ink is carried out on a hydrophilic resin to render an image area hydrophobic as described above, while in the present invention, there is provided an epoch-making lithographic printing plate of direct image type having advantages obtained by both the hydrophilic property and hydrophobic property of the resin grains based on the concept that the lipophilic resin grains are subjected to surface treatment to render a non-image area hydrophilic. This concept is completely different from that of the prior art.

The resin grains of the present invention contains at least one functional group capable of producing at least one polar group through decomposition and optionally at least partially crosslinked structure. It is important that the resin grains are dispersed, as grains, in the image receptive layer independently of a binder resin as a matrix of the image receptive layer. Thus, the printing plate of direct imaging type according to the present invention can form an image area and non-image area, faithful to an original, and provide a good quality printed image free from background stain. Furthermore, the resin grains being fixed by the binder resin do not tend to be separated during various processings and some protection can also be given by the binder resin.

Therefore, the lithographic printing plate of direct imaging type of the present invention has the feature that it is favorably prevented from occurrence of background stains and it is excellent in printing durability, independently of the ambient atmosphere during plate making, and in storage property before processings.

When the resin grains form polar groups, it is feared that the resin grains flow out due to the hydrophilic property of the groups by dampening water, etc. during printing, but this problem can be resolved by partially or fully crosslinking them.

Functional groups contained in the resins to be used in the present invention produce polar groups through decomposition and one of more polar groups may be produced from one functional group. In preferred embodiments of the present invention, the polar groups include carboxyl group, hydroxyl group, thiol group, phosphono group, amino group and sulfo group, and the like.

In accordance with a first preferred embodiment of this invention, the resins containing carboxyl group-producing functional groups are those containing at least one kind of functional group represented by formula (I):

$$-COO-L_1 \qquad (I)$$

In the foregoing formula $-COO-L_1$, $L_1$ represents

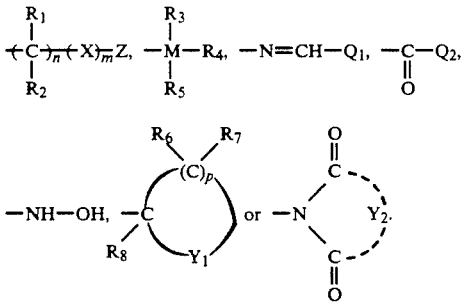

Therein, $R_1$ and $R_2$ (which may be the same or different) each represents a hydrogen atom or an aliphatic group; X represents an aromatic group; Z represents a hydrogen atom, a halogen atom, a trihalomethyl group, an alkyl group, —CN, $-NO_2$, $-SO_2R_1$, (wherein $R_1$, represents a hydrocarbon group, $-COOR_2$, (wherein $R_2$, represents a hydrocarbon group), or $-O-R_3$, (wherein $R_3$, represents a hydrocarbon group); n and m are each 0, 1, or 2; $R_3$, $R_4$, and $R_5$ (which may be the same or different) each represents a hydrocarbon group, or $-O-R_4$, (wherein $R_4$, represents a hydrocarbon group; M represents Si, Sn, or Ti; $Q_1$ and $Q_2$ each represent a hydrocarbon group; $Y_1$ represents an oxygen atom, or a sulfur atom; $R_6$, $R_7$, and $R_8$ (which may be the same or different) each represents a hydrogen atom, a hydrocarbon group; or $-O-R_5$, (wherein $R_5$, represents a hydrocarbon group); p represents an integer of 3 to 6; and $Y_2$ represents an organic residue to complete a cyclic imido group.

The above-described hydrocarbon group means an aliphatic group including a chain or cyclic alkyl, alkenyl or aralkyl group, and an aromatic group including a phenyl or naphthyl group, and these hydrocarbons may be substituted.

The functional groups of formula $-COO-L_1$, which produce a carboxyl group through decomposition, are described in greater detail below.

In one case where $L_1$ represents

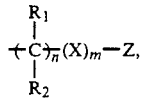

and $R_2$ (which may be the same or different) each preferably represents a hydrogen atom, or an optionally substituted straight or branched chain alkyl group containing 1 to 12 carbon atoms (e.g., methyl, ethyl, propyl, chloromethyl, dichloromethyl, trichloromethyl, trifluoromethyl, butyl, hexyl, octyl, decyl, hydroxyethyl, 3-chloropropyl); X preferably represents an optionally substituted phenyl or naphthyl group (e.g., phenyl, methylphenyl, chlorophenyl, dimethylphenyl, chloromethylphenyl, naphthyl); Z preferably represents a hydrogen atom, a halogen atom (e.g., chlorine, fluorine), a trihalomethyl group (e.g., trichloromethyl, trifluoromethyl), an optionally substituted straight- or branched-chain alkyl group containing 1 to 12 carbon atoms (e.g., methyl, chloromethyl, dichloromethyl, ethyl, propyl, butyl, hexyl, tetrafluoroethyl, octyl, cyanoethyl, chloroethyl), —CN, $-NO_2$, $-SO_2R_1$, [where $R_1$, represents an aliphatic group (e.g., an optionally substituted alkyl group having 1 to 12 carbon atoms, including methyl, ethyl, propyl, butyl, chloroethyl, pentyl, octyl, etc.; an optionally substituted aralkyl group containing from 7 to 12 carbon atoms, including benzyl, phenetyl, chlorobenzyl, methoxybenzyl, chlorophenetyl, methylphenetyl, etc.); or an aromatic group (e.g., an optionally substituted phenyl or naphthyl group, including phenyl, chlorophenyl, dichlorophenyl, methylphenyl, methoxyphenyl, acetylphenyl, acetamidophenyl, methoxycarbonylphenyl, naphthyl, etc.)], $-COOR_2$, (wherein $R_2$, has the same meaning as $R_1$,); or $-O-R_3$, (wherein $R_3$, has the meaning as $R_1$,); and n and m each represents 0, 1, or 2.

In the case where $L_1$ represents

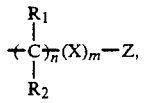

specific examples of such a substituent group include β,β,β-trichloroethyl group, β,β,β-trifluoroethyl group, hexafluoro-iso-propyl group, groups of the formula $-(CH_2-CF_2CF_2)_{n'}H$ (n'=1-5), 2-cyanoethyl group, 2-nitroethyl group, 2-methanesulfonylethyl group, 2-ethanesulfonylethyl group, 2-butanesulfonylethyl group, benzenesulfoncyanobenzenesulfonylethyl group, 4-methylbenzenesulfonylethyl group, unsubstituted and substituted benzyl groups (e.g., benzyl, methoxybenzyl, trimethylbenzyl, pentamethylbenzyl, nitrobenzyl), unsubstituted and substituted phenacyl groups (e.g., phenacyl, bromophenacyl), and unsubstituted and substituted phenyl groups (e.g., phenyl, nitrophenyl, cyanophenyl, methanesulfonylphenyl, trifluoromethylphenyl, dinitrophenyl).

In the case where $L_1$ represents

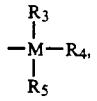

and $R_5$ (which may be the same or different) each preferably represents an optionally substituted aliphatic group containing 1 to 18 carbon atoms [wherein the aliphatic group includes an alkyl group, an alkenyl group, an aralkyl group and an alicyclic group, which each may be substituted, e.g., by a halogen atom, —CN, —OH, —O—Q' represents an alkyl group, an aralkyl group, an alicyclic group, or an aryl group), etc.], an optionally substituted aromatic group containing 6 to 18 carbon atoms (e.g., phenyl, tolyl, chlorophenyl, methoxyphenyl, acetamidophenyl, naphthyl), or —O—$R_4$, (wherein $R_4$, represents an optionally substituted alkyl group containing 1 to 12 carbon atoms, an optionally substituted alkenyl group containing 2 to 12 carbon atoms, an optionally substituted aralkyl group containing 7 to 12 carbon atoms, an optionally substituted alicyclic group containing 5 to 18 carbon atoms, or an optionally substituted aryl group containing 6 to 18 carbon atoms); and M represents Si, Ti, or Sn, preferably Si.

In other cases where Ll represents —N=CH—$Q_1$ or —CO—$Q_2$, $Q_1$ and $Q_2$ each represents, preferably, an optionally substituted aliphatic group containing 1 to 18 carbon atoms (wherein the aliphatic group include an alkyl group, an alkenyl group, an aralkyl group and an alicyclic group, which each may be substituted, e.g., by a halogen atom, —CN, an alkoxy group, etc.), or an optionally substituted aryl group containing 6 to 18 carbon atoms (e.g., phenyl, methoxyphenyl, tolyl, chlorophenyl, naphthyl).

In still another case wherein $L_1$ represents

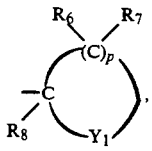

$Y_1$ represents an oxygen atom, or a sulfur atom; $R_6$, $R_7$ and $R_8$ may be the same or different, and each preferably represents a hydrogen atom, an optionally substituted straight- or branched-chain alkyl group containing 1 to 18 carbon atoms (e.g., methyl, ethyl, propyl, butyl, hexyl, octyl, decyl, dodecyl, octadecyl, chloroethyl, methoxyethyl, methoxypropyl), an optionally substituted alicylic group (e.g., cyclopentyl, cyclohexyl), an optionally substituted aralkyl group containing 7 to 12 carbon atoms (e.g., benzyl, phenetyl, chlorobenzyl, methoxybenzyl), an optionally substituted aromatic group (e.g., phenyl, naphthyl, chlorophenyl, tolyl, methoxyphenyl, methoxycarbonylphenyl, dichlorophenyl), or —O—$R_5$, (wherein $R_5$, represents a hydrocarbon group, including the same groups as those cited as examples of $R_6$, $R_7$, and $R_8$; and p represents an integer of 3 to 6.

In a further case where $L_1$ represents

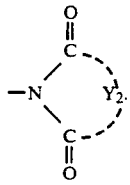

$Y_2$ represents an organic group completing a cyclic imido group. Preferred examples of such a group include those represented by the following formulae (II) and (III).

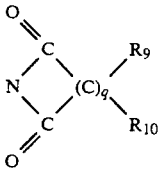

(II)

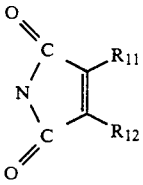

(III)

In formula (II), $R_9$ and $R_{10}$ (which may be the same or different) each represents a hydrogen atom, a halogen atom (e.g., chlorine, bromine), an optionally substituted alkyl group containing 1 to 18 carbon atoms (e.g., methyl, ethyl, propyl, butyl, hexyl, octyl, decyl, dodecyl, hexadecyl, octadecyl, 2-chloroethyl, 2-methoxyethyl, 2-cyanoethyl, 3-chloropropyl, 2-(methanesulfonyl)ethyl, 2-(ethoxyoxy)ethyl), an optionally substituted aralkyl group containing 7 to 12 carbon atoms (e.g., benzyl, phenetyl, 3-phenylpropyl, methylbenzyl, dimethylbenzyl, methoxybenzyl, chlorobenzyl, bromobenzyl), an optionally substituted alkenyl group containing 3 to 18 carbon atoms (e.g., allyl, 3-methyl-2-propenyl, 2- hexenyl, 4-propyl-2-pentenyl, -12-octadecenyl), —S—$R_6$, (wherein $R_6$, represents a substituent group including the same alkyl, aralkyl and alkenyl groups as the foregoing $R_9$ and $R_{10}$ represent, or an optionally substituted aryl group (e.g., phenyl, tolyl, chlorophenyl, bromophenyl, methoxyphenyl, ethoxyphenyl, ethoxycarbonylphenyl)), or —NH$R_7$, (wherein $R_7$, has the same meaning as $R_6$,); and further, the combination of $R_9$ and $R_{10}$ may form a ring group such as a 5- or 6-membered single ring group (e.g., cyclopentyl, cyclohexyl), or a 5- or 6-membered ring-containing bicyclo ring (e.g., a bicyloheptane ring, a bicycloheptene ring, a bicyclooctane ring, a bicyclooctene ring), which each may be substituted by a group as cited as examples of the foregoing $R_9$ and $R_{10}$.

q represents an integer of 2 or 3.

In the foregoing formula (III), $R_{11}$ and $R_{12}$ (which may be the same or different) each has the same meaning as the foregoing $R_9$ or $R_{10}$. In addition, $R_{11}$ and $R_{12}$ may combine with each other to complete an aromatic ring (e.g., a benzene ring, a naphthalene ring).

In another preferred embodiment, the resin of this invention contains at least one kind of functional group represented by formula (IV).

$$CO—L_2 \quad \text{(IV)}$$

In the above formula, L2 represents

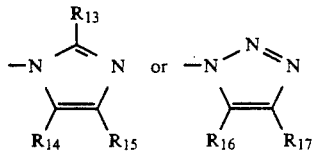

(wherein $R_{13}$, $R_{14}$, $R_{15}$, $R_{16}$ and $R_{17}$ each represents a hydrogen atom, or an aliphatic group).

Preferred examples of such an aliphatic group include those represented by the foregoing $R_6$, $R_7$, and $R_8$. In addition, the combination of $R_{14}$ and $R_{15}$, and that of $R_{16}$ and $R_{17}$, may be an organic group completing a condensed ring, with preferred examples including 5- to 6-membered single rings (e.g., cyclopentene, cyclohexene) and 5- to 12-membered aromatic rings (e.g., benzene, naphthalene, thiophene, pyrrole, pyran, quinoline).

In still another preferred embodiment, the resin of this invention contains at least one kind of oxazolone ring represented by the formula (V).

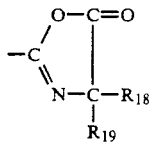

(V)

In the above formula (V), $R_{18}$ and $R_{19}$ may be the same or different, and each represents a hydrogen atom or a hydrocarbon group, or they may combine with each other to form a ring.

Preferably, $R_{18}$ and $R_{19}$ are each a hydrogen atom, an optionally substituted straight- or branched-chain alkyl group containing 1 to 12 carbon atoms (e.g., methyl, ethyl, propyl, butyl, hexyl, 2-chloroethyl, 2-methoxyethyl, 2-methoxycarbonylethyl, 3-hydroxypropyl), an optionally substituted aralkyl group containing 7 to 12 carbon atoms (e.g., benzyl, 4-chlorobenzyl, 4-acetamidobenzyl, phenetyl, 4-methoxybenzyl), an optionally substituted alkenyl group containing 2 to 12 carbon atoms (e.g., ethylene, allyl, isopropenyl, butenyl, hexenyl), an optionally substituted 5- to 7-membered alicyclic ring group (e.g., cyclopentyl, cyclohexyl, chlorocyclohexyl), or an optionally substituted aromatic group (e.g., phenyl, chlorophenyl, methoxyphenyl, acetamidophenyl, methylphenyl, dichlorophenyl, nitrophenyl, naphthyl, butylphenyl, dimethylphenyl), or the combination of $R_{18}$ and $R_{19}$ is a group completing a ring (e.g., tetramethylene, pentamethylene, hexamethylene).

The resins containing at least one kind of functional group selected from among those of the general formulae (I) to (V) can be prepared using a method which involves converting carboxyl groups contained in a polymer to the functional group represented by formula —COO—$L_1$ or —CO—$L_2$ according to the polymer reaction, or a method which involves polymerizing one or more of a monomer containing one or more of a functional group of the general formula —COO—$L_1$ or —CO—$L_2$, or copolymerizing one or more of said monomer and other copolymerizable monomers according to a conventional polymerization reaction.

These preparation methods are described in detail in known literatures cited, e.g., in Nihon Kagakukai (ed.) *Shin-Jikken Kaqaku Koza*, vol. 14, "Yuki Kagobutsu no Gosei to Han-no (V)", p. 2535, Maruzen K. K., Yoshio Iwakura and Keisuke Kurita, *Hannosei Kobunshi* (*Reactive High Molecules*), p. 170, Kodansha, Tokyo.

The method of preparing a polymer from monomers previously containing one or more of the functional group represented by the general formula —COO—$L_1$ or —CO—$L_2$ in accordance with a polymerization reaction is preferred, because the functional group(s) of the formula —COO—$L_1$ or —CO—$L_2$ to be introduced into the polymer can be controlled at one's option, the prepared polymer is not contaminated by impurities, and so on. More specifically, the resins of this invention can be prepared by converting carboxyl group(s) contained in polymerizing double bond-containing carboxylic acids or their halides to the functional group of the formula —COO—$L_1$ or —CO—$L_2$ according to some methods described in known literatures as cited above, and then by carrying out a polymerization reaction.

On the other hand, the resins containing oxazolone rings represented by formula (V) can be prepared by polymerizing one or more of a monomer containing said oxazolone ring, or by copolymerizing the monomer of the above-described kind and other monomers copolymerizable with said monomer.

These oxazolone ring-containing monomers can be prepared from N-acyloyl-α-amino acids containing a polymerizing unsaturated double bond through the dehydrating ring-closure reaction. More specifically, they, can be prepared using methods described, e.g., in Yoshio Iwakura & Keisuke Kurita, *Hannosei Kobunshi* (*Reactive Hiqh Molecules*), chap. 3, Kodansha.

Specific examples of other monomers capable of copolymerizing with the monomers containing the functional groups of this invention include aliphatic carboxylic acid vinyl or allyl esters, such as vinyl acetate, vinyl propionate, vinyl butyrate, allyl acetate, allyl propionate, etc.; esters or amides of unsaturated carboxylic acids, such as acrylic acid, methacrylic acid, crotonic acid, itaconic acid, maleic acid, fumaric acid, etc.; styrene derivatives, such as styrene, vinyltoluene, α-methylstyrene, etc.; α-olefins; acrylonitrile; methacrylonitrile; and vinyl-substituted heterocyclic compounds, such as N-vinylpyrrolidone, etc.

Specific, but not limiting, examples of the copolymer constituent containing the functional group of the general formulae (I) to (V) to be used, as described above, in the method of preparing a desired resin through the polymerization reaction include those represented by formula (VI).

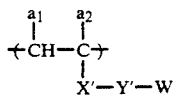

(VI)

wherein X′ represents —O—, —CO—, —COO—, —OCO—, $$-\overset{d_1}{\overset{|}{N}}CO-,\ -CO\overset{d_2}{\overset{|}{N}}-,\ -SO_2-,\ -SO_2\overset{d_3}{\overset{|}{N}}-,\ -\overset{d_4}{\overset{|}{N}}SO_2-.$$

$$-CH_2COO-,\ -CH_2OCO-,\ -\overset{b_1}{\underset{b_2}{\overset{|}{\underset{|}{(C)_l}}}}-,$$

an aromatic group, or a heterocyclic group (wherein $d_1$, $d_2$, $d_3$ and $d_4$ each represent a hydrogen atom, a hydrocarbon group, or the moiety -Y′-W in the formula (VI); $b_1$ and $b_2$ may be the same or different, each being a hydrogen atom, a hydrocarbon residue or the moiety -Y′-W in the formula (VI); and l is an integer of from 0 to 18); Y′ represents a carbon-carbon bond or chain for connecting the linkage group X′ to the functional group -W, between which hetero atoms (including oxygen, sulfur and nitrogen atom) may be present, which specific examples include

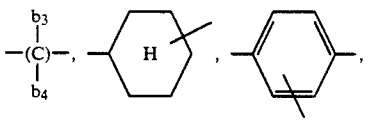

$$\text{-}(CH{=}CH)\text{-},\ -O-,\ -S-,\ -\overset{b_5}{\overset{|}{N}}-,$$

—COO—, —CONH—, —$SO_2$—, —$SO_2$NH—, —NHCOO—, —NHCONH—or a combination of one or more of these groups (wherein $b_3$, $b_4$ and $b_5$ each have the same meaning as the foregoing $b_1$ or $b_2$); W represents the functional group represented by the formula (I) to (V); and $a_1$ and $a_2$ may be the same or different, each being a hydrogen atom, a halogen atom (e.g., chlorine, bromine), a cyano group, a hydrocarbon residue (e.g., an optionally substituted alkyl group containing 1 to 12 carbon atoms, such as methyl, ethyl, propyl, butyl, an alkoxycarbonyl group such as methoxycarbonyl, ethoxycarbonyl, propoxycarbonyl, butoxycarbonyl, hexyloxycarbonyl, an alkoxycarbonylmethyl group such as methoxycarbonylmethyl, ethoxycarbonylmethyl, butoxycarbonylmethyl, etc., an aralkyl group such as benzyl, phenetyl, etc., and an aryl group such as phenyl, tolyl, xylyl, chlorophenyl, etc.), or an alkyl group containing 1 to 18 carbon atoms, an alkenyl group, an aralkyl group, an alicyclic group or an aryl group, which each may be substituted by a group containing the functional moiety W in the formula (VI).

In addition, the linkage moiety —X′—Y′—in the formula (VI) may directly connect the moiety $$\text{-}(\overset{a_2}{\overset{|}{\underset{|}{C}}})\text{-}$$

to the moiety W.

W represents the functional group of the formulae (I) to (V).

Specific but non-limiting examples of the functional groups of formulae (I) to (V) (or W in the formula (VI)) are illustrated below.

(1)

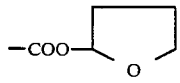

(2)

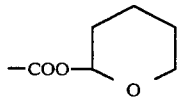

(3)

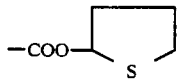

(4)

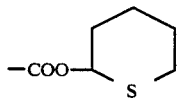

(5)

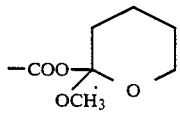

(6)

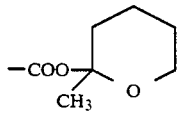

(7)

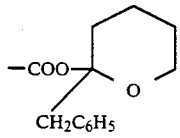

(8)

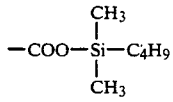

(9)

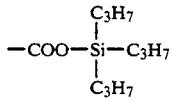

(10)

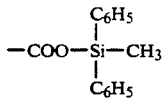

(11)

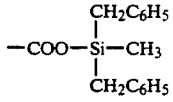

(12)

$$-COOCH_2CF_3$$

(13)

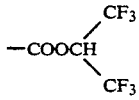

(14)

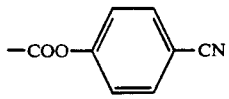

-continued
(15)
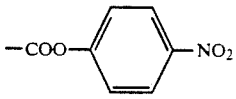
(16)
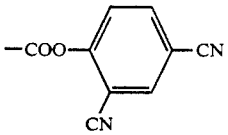
(17)
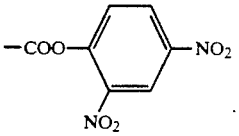
(18)
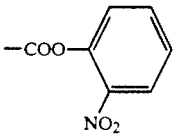
(19)
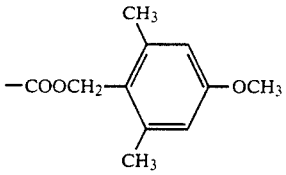
(20)
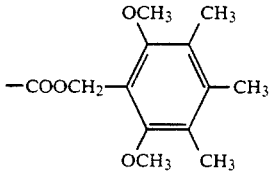
(21)
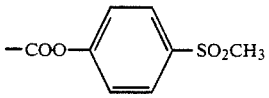
(22)
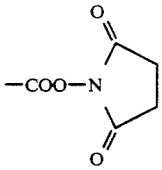
(23)
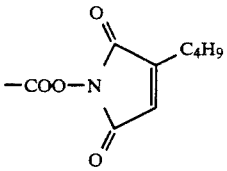
(24)
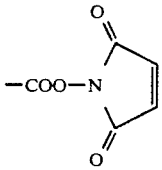
-continued
(25)
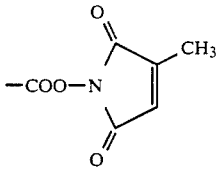
(26)
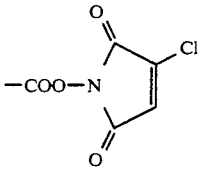
(27)
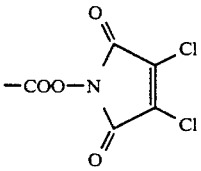
(28)
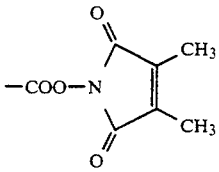
(29)
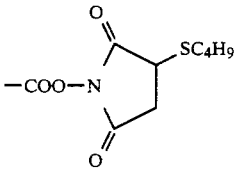
(30)
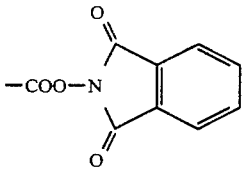
(31)
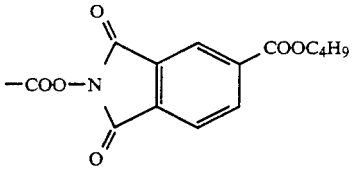
(32)
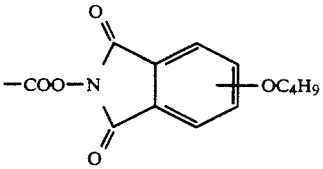
(33)
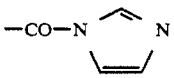
(34)
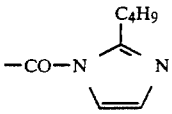

-continued (35)

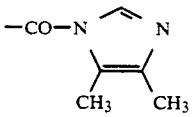

(36)

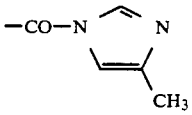

(37)

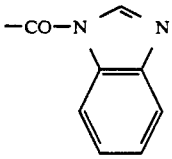

(38)

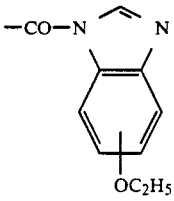

(39)

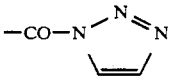

(40)

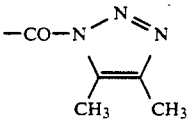

(41)

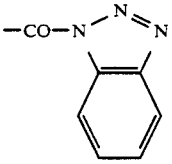

(42)

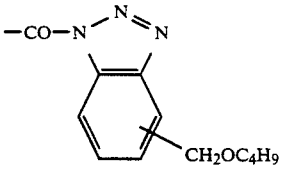

(43)

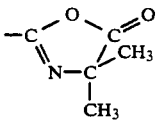

(44)

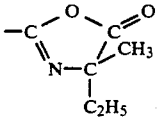

(45)

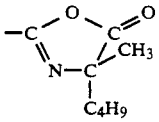

-continued (46)

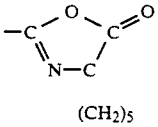

(47)

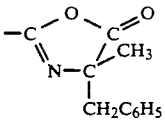

(48) $-COOCH_2OCH_3$ (49)

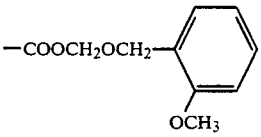

(50) $-COOC(C_6H_5)_3$

(51) $-COOCH(C_6H_5)_2$ (52)

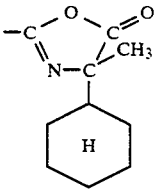

In the resin of the present invention, in particular, consisting of a copolymer, the repeating unit containing carboxyl group-producing functional group is in a proportion of 1 to 95% by weight, preferably 5 to 90% by weight, more preferably 20 to 60% by weight to the resin. Generally, the polymer or copolymer of the resin has a molecular weight of $10^3$ to $10^6$, preferably $5\times10^3$ to $5\times10^5$.

In accordance with a second preferred embodiment of this invention, the resins containing hydroxyl group-producing functional groups are those containing at least one kind of functional group represented by the general formula (I):

$$-O-L$$

In the general formula (I), L represents

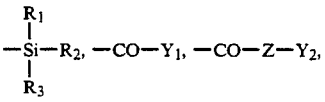

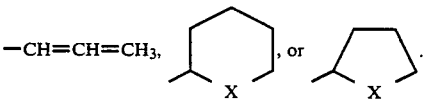

Therein, $R_1$, $R_2$ and $R_3$ may be the same or different, and each represents a hydrogen atom, a hydrocarbon residue, or —O—R′ (R′=a hydrocarbon residue); $Y_1$ and $Y_2$ each represents a hydrocarbon residue; Z represents an oxygen atom, a Sulfur atom or —NH—group; and X represents a sulfur atom, or an oxygen atom.

The functional groups of the foregoing general formula —O—L, which produce a hydroxyl group through decomposition, are described in greater detail.

In the case where L represents

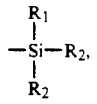

$R_1$, $R_2$ and $R_3$ may be the same or different, each preferably representing a hydrogen atom, an optionally substituted straight or branched chain alkyl group containing 1 to 18 carbon atoms (e.g., methyl, ethyl, propyl, butyl, hexyl, octyl, decyl, dodecyl, octadecyl, chloroethyl, methoxyethyl, methoxypropyl), an optionally substituted alicyclic group (e.g., cyclopentyl, cyclohexyl), an optionally substituted aralkyl group containing 7 to 12 carbon atoms (e.g., benzyl, phenethyl, fluorobenzyl, chlorobenzyl, methylbenzyl, methoxybenzyl, 3-phenylpropyl), an optionally substituted aromatic group (e.g., phenyl, naphthyl, chlorophenyl, tolyl, methoxyphenyl, methoxycarbonylphenyl, dichlorophenyl), or —O—R' (wherein R' represents a hydrocarbon residue, with specific examples including the same ones cited above as examples of $R_1$, $R_2$ and $R_3$).

In the case where L represents —CO—$Y_1$, $Y_1$ preferably represents an optionally substituted straight or branched chain alkyl group containing 1 to 6 carbon atoms (e.g., methyl, trichloromethyl, trifluoromethyl, methoxymethyl, phenoxymethyl, 2,2,2-trifluoroethyl, t-butyl, hexafluoro-i-propyl), an optionally substituted aralkyl group containing 7 to 9 carbon atoms (e.g., benzyl, phenethyl, methylbenzyl, trimethylbenzyl, heptamethylbenzyl, methoxybenzyl), or an optionally substituted aryl group containing 6 to 12 carbon atoms (e.g., phenyl, nitrophenyl, cyanophenyl, methanesulfonylphenyl, methoxyphenyl, butoxyphenyl, chlorophenyl, dichlorophenyl, trifluoromethylphenyl).

In the case where L represents —CO—Z—$Y_2$, Z is an oxygen atom, a sulfur atom, or a —NH—linkage group; and $Y_2$ has the same meaning as the foregoing $Y_1$.

In the case where L represents or

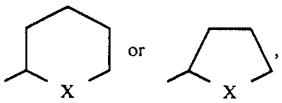

X represents an oxygen atom or a sulfur atom.

The resins containing at least one kind of functional group selected from those of the general formula —O—L can be prepared using a method which involves converting hydroxyl groups contained in a polymer to the functional group represented by the general formula —O—L according to the high-molecular reaction, or a method which involves polymerizing one or more of a monomer containing one or more of a functional group of the general formula —O—L, or copolymerizing one or more of said monomer and other copolymerizable monomers according to a conventional polymerization reaction.

For example, the high-molecular reaction is disclosed in Yoshio Iwakura and Keisuke Kurita, *Hannosei Kobunshi* (*Reactive Hiqh Molecules*), p. 158, Kodansha, Tokyo, and methods of converting a hydroxyl group contained in a monomer to the functional group represented by the general formula —O—L are described in detail, e.g., in Nihon Kagakukai (ed.), *Shin-Jikken Kaqaku Koza*, vol. 14, "Yuki Kagobutsu no Gosei to Han-no (V)", p. 2497, Maruzen K. K.

The method of preparing a polymer from monomers previously containing functional groups of the general formula —O—L in accordance with a polymerization reaction is preferred, because functional groups to be introduced into the polymer can be readily controlled such that the prepared polymer is not contaminated with imprities, etc. These monomers can be prepared by converting at least one hydroxyl group contained in a compound having a polymerizing double bond into the functional group of the general formula —O—L according to method as described above, or by reacting a compound containing the functional group of the general formula —O—L with a compound having a polymerizing double bond.

The monomers containing the functional groups of the general formula —O—L to be used, as described above, in preparing a desired resin by a polymerization reaction include, for example, compounds represented by the following general formula (II).

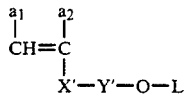

(II)

wherein X' represents

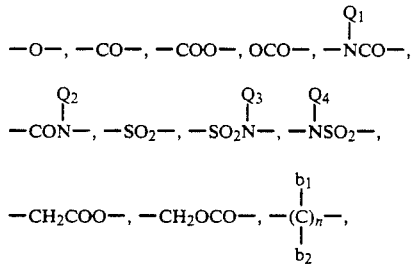

an aromatic group, or a heterocyclic group (wherein $Q_1$, $Q_2$, $Q_3$ and $Q_4$ each represent a hydrogen atom, a hydrocarbon residue, or the moiety —Y'—O—L in formula (II); $b_1$ and $b_2$ may be the same or different, each being a hydrogen atom, a hydrocarbon residue or the moiety —Y'—O—L in formula (II ; and n is an integer of from 0 to 18); Y' represents carbon-carbon bond(s) for connecting the linkage group X' to the functional group —O—L, between which hetero atoms (e.g., oxygen, sulfur, nitrogen) may be present, specific examples including, individually or in combination,

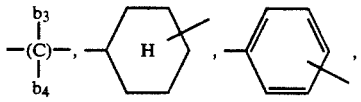

—(CH=CH)—, —O—, —S—,

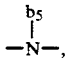

—COO—, —CONH, —$SO_2$—, —$SO_2$NH—, —NHCOO—or/and —NHCONH—(wherein $b_3$, $b_4$ and $b_5$ each have the same meaning as the foregoing $b_1$ or $b_2$); L has the same meaning as in the formula (I); and $a_1$ and $a_2$ may be the same or different, each being a hydrogen atom, a hydrocarbon residue (e.g., an alkyl group containing 1 to 12 carbon atoms, which may be substituted with —COOH or so on), —COOH or —COO—W (wherein W represents an alkyl group containing 1 to 18 carbon atoms, an alkenyl group, an aralkyl group, an alicyclic group or an aromatic group, each of which may be substituted with a group including the functional group of the formula —O—L).

Specific but non-limiting examples of monomers containing the functional group of the general formula —O—L are illustrated below, wherein Me represents a methyl group.

(1)

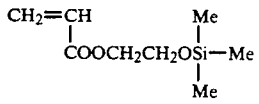

(2)

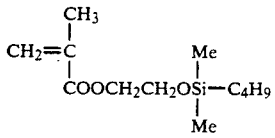

(3)

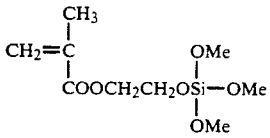

(4)

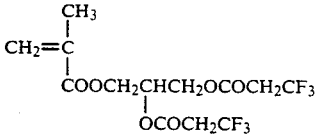

(5)

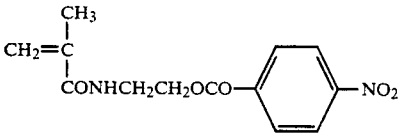

(6)

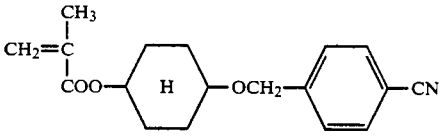

(7)

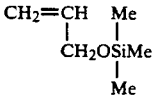

(8)

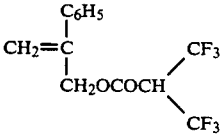

(9)

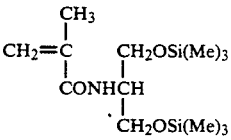

-continued (10)

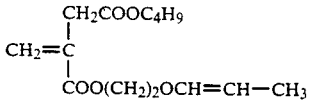

(11)

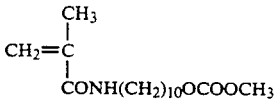

(12)

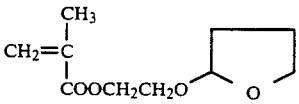

(13)

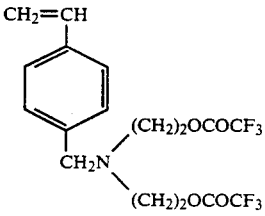

(14)

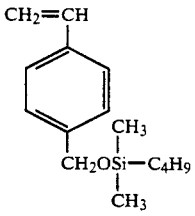

(15)

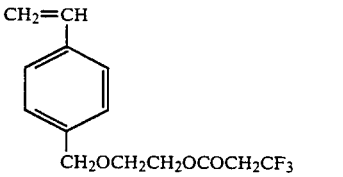

(16)

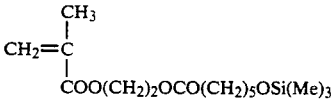

(17)

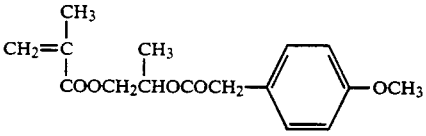

(18)

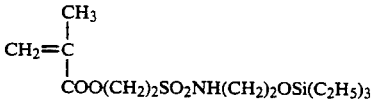

(19)

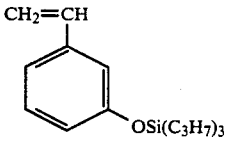

(20)

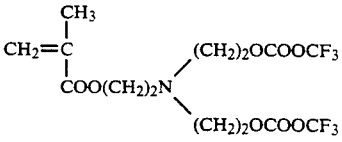

-continued (21)

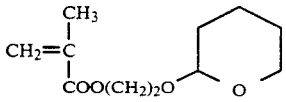

(22)

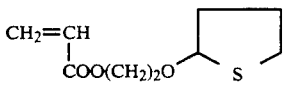

(23)

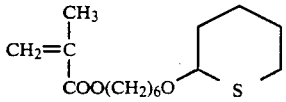

(24)

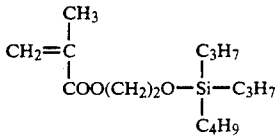

These monomers may be either homopolymerized or copolymerized with other copolymerizable monomers. Suitable examples of other copolymerizing monomers include vinyl or allyl esters of aliphatic carboxylic acids, such as vinyl acetate, vinyl propionate, vinyl butyrate, allyl acetate, allyl propionate, etc.; esters or amides of unsaturated carboxylic acids such as acrylic acid, methacrylic acid, crotonic acid, itaconic acid, maleic acid, fumaric acid, etc.; styrene derivatives such as styrene, vinyl toluene, α-methylstyrene, etc.; α-olefins; acrylonitrile; methacrylonitrile; and vinyl-substituted heterocyclic compounds such as N-vinylpyrrolidone, etc.

In this embodiment, preferably, the resins containing hydroxyl group-producing functional groups are those containing at least one kind of functional group which has at least two hydroxyl groups located in a position sterically next to each other in such a form as to both be protected by a single protecting group. Specific examples of such functional groups are those represented by the following general formulae (III), (IV), (V) and (VI):

(III)

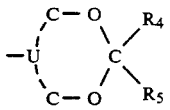

(wherein $R_4$ and $R_5$ may be the same or different, each being a hydrogen atom, a hydrocarbon residue, or —O—O—R″ (wherein R″ represents a hydrocarbon residue); and U represents a carbon-carbon chain in which a hetero atom may be introduced (provided that the number of atoms present between the two oxygen atoms does not exceed 5))

(IV)

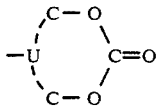

(wherein U has the same meaning as in (III))

(V)

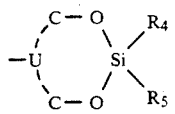

(wherein $R_4$, $R_5$ and U have the same meanings as in (III), respectively).

(VI)

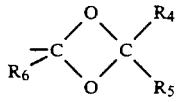

(wherein $R_4$ and $R_5$ have the same meanings as in (III) respectively and $R_6$ represents a hydrogen atom or an aliphatic group containing 1 to 8 carbon atoms (e.g., alkyl groups such as methyl, ethyl, propyl, butyl, etc., or aralkyl groups such as benzyl, phenethyl, methylbenzyl, methoxybenzyl, chlorobenzyl, etc.).)

These functional groups are more specifically described below.

In the formula (III), $R_4$ and $R_5$ may be the same or different, and each preferably represents a hydrogen atom, an alkyl group containing 1 to 12 carbon atoms, which may be substituted (e.g., methyl, ethyl, propyl, butyl, hexyl, 2-methoxyethyl, octyl), an aralkyl group containing 7 to 9 carbon atoms, which may be substituted (e.g., benzyl, phenethyl, methylbenzyl, methoxybenzyl, chlorobenzyl), an alicyclic residue containing 5 to 7 carbon atoms (e.g., cyclopentyl, cyclohexyl), an aryl group, which may be substituted (e.g., phenyl, chlorophenyl, methoxyphenyl, methylphenyl, cyanophenyl), or —O—R‴ (wherein R‴ represents the same hydrocarbon residue as $R_4$ and $R_5$).

U represents a carbon-carbon chain in which hetero atoms may be introduced, provided that the number of atoms present between the two oxygen atoms does not exceeding 5.

Resins containing at least one kind of functional groups for use in the present invention are prepared in accordance with a method which involves utilizing a high-molecular reaction. As such, the hydroxyl groups in a polymer which are located in a position sterically next to each other are transformed in such a manner that they are protected by a protecting group. Methods which involve polymerizing a monomer which contains prior to polymerization at least two hydroxyl groups protected by a protecting group, or copolymerizing said monomer and other copolymerizing monomers in accordance with a polymerization reaction may also be used in the present invention.

In the former preparation method which utilizes a high-molecular reaction, polymers having a repeating unit as illustrated below, which have at least two hydroxyl groups adjacent to each other or one hydroxyl group in such a position as to be near a hydroxyl group in another unit as the result of polymerization, for example, (i)

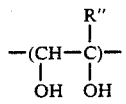

-continued

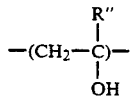
(ii)

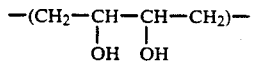
(iii)

(wherein R'' represents H, or a substituent such as $CH_3$)

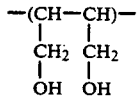
(iv)

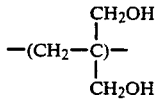
(v)

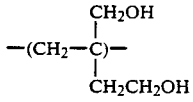
(vi)

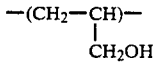
(vii)

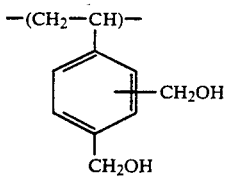
(viii)

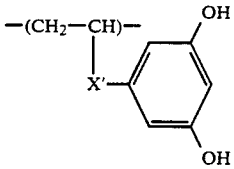
(ix)

(X' = linkage group)

or the like, are allowed to react with a carbonyl compound, an ortho ester compound, a halogen-substituted formic acid ester, a dihalogenated silyl compounds, or the like to result in formation of the intended functional groups having at least two hydroxyl groups protected by the same protecting group.

More specifically, such polymers can be prepared in accordance with known methods described in, e.g., Nihon Kagakukai (ed.), *Shin*-Jikken Kagaku Koza, vol. 14, "Yuki Kagobutsu no Gosei to Han-no (V)", p. 2505, Maruzene K. K., and J. F. W. McOmie, Protective Groups in *Organic Chemistry*, chaps. 3 to 4, Plenum Press.

In the latter method, monomers initially having at least two protected hydroxyl groups are first prepared in accordance by methods cited in the aforementioned publications, and then polymerized, if desired, in the presence of other copolymerizing monomers in a conventional polymerization process to obtain a homopolymer or a copolymer.

Specific but non-limiting examples of the repeating units having the foregoing kind of functional groups to be present in the polymers of this invention are shown as follows:

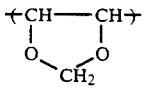
(25)

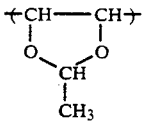
(26)

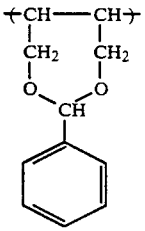
(27)

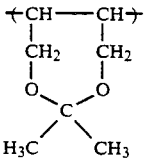
(28)

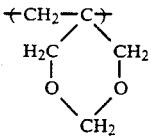
(29)

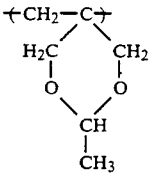
(30)

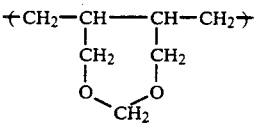
(31)

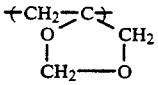
(32)

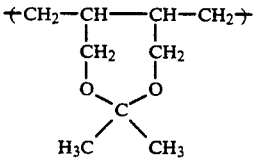
(33)

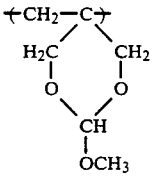
(34)

-continued (35)

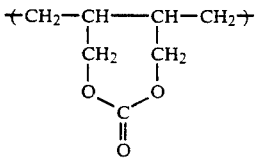

(36)

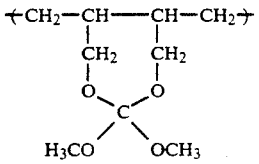

(37)

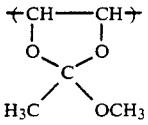

(38)

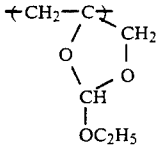

(39)

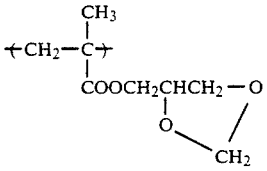

(40)

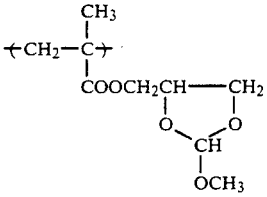

(41)

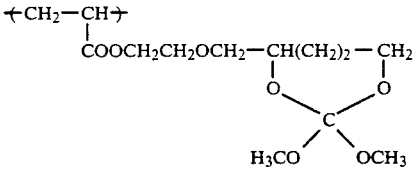

(42)

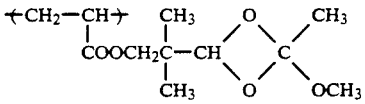

(43)

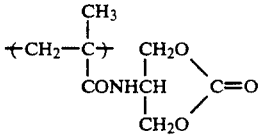

(44)

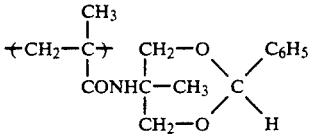

-continued (45)

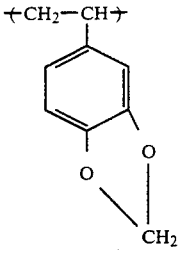

(46)

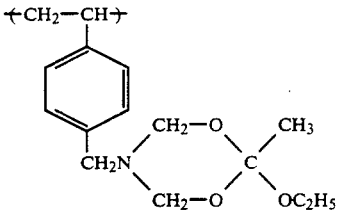

(47)

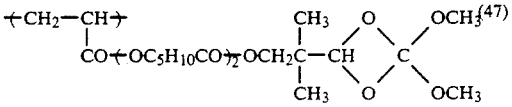

(48)

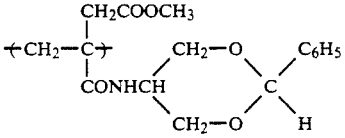

(49)

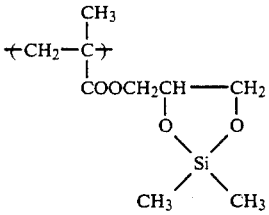

(50)

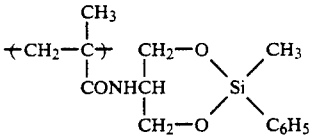

In the resin of the present invention, in particular, consisting of a copolymer, the repeating unit containing hydroxyl group-producing functional group is in a proportion of 1 to 95% by weight, preferably 5 to 60% by weight to the resin. Generally, the polymer or copolymer of the resin has a molecular weight of $10^3$ to $10^6$, preferably $5\times10^3$ to $5\times10^5$.

When the resin of the present invention consists of a copolymer, as monomers to be copolymerized with a monomer containing the above described hydroxyl group-producing functional group, there can be used α-olefins, vinyl or allyl esters of alkanic acids, acrylonitrile, methacrylonitrile, vinyl ethers, acrylamides, methacrylamides, styrenes and heterocyclic vinyl compounds such as vinylpyrrolidone, vinylpyridine, vinylimidazole, vinylthiophene, vinylimidazoline, vinylpyrazole, vinyldioxane, vinylquinoline, vinylthiazole, vinyloxazine and the like. Above all, vinyl acetate, allyl acetate, acrylonitrile, methacrylonitrile and styrenes are preferably used from the standpoint of increasing the film strength.

In accordance with a third preferred embodiment of the present invention, the resins containing thiol group-producing functional groups are those containing at least one kind of functional groups represented by general formula (I):

$$(\text{-}S\text{-}L^A) \qquad (I)$$

wherein $L^A$ represents

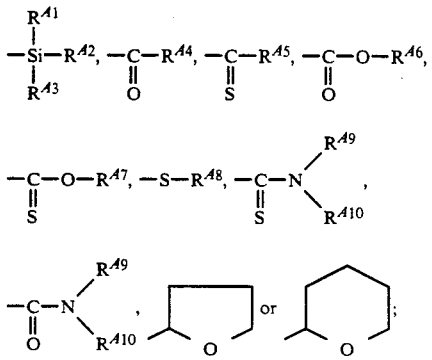

wherein $R^{A1}$, $R^{A2}$, and $R^{A3}$, which may be the same or different, each represents a hydrocarbon group or —O—$R^{A'}$ (wherein $R^{A'}$ represents a hydrocarbon group); and $R^{A4}$, $R^{A5}$, $R^{A6}$, $R^{A7}$, $R^{A8}$, $R^{A9}$, and $R^{A10}$ independently each represents a hydrocarbon group.

The functional group of the formula —S—$L^A$) forms a thiol group by decomposition, which is explained in detail hereinafter.

When $L^A$ represents

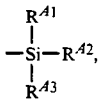

$R^{A1}$, $R^{A2}$ and $R^{A3}$ may be the same or different and each preferably represents a hydrogen atom, an optionally substituted linear or branched alkyl group having from 1 to 18 carbon atoms (e.g., methyl, ethyl, propyl, butyl, hexyl, octyl, decyl, dodecyl, octadecyl, chloroethyl, methoxyethyl, methoxypropyl), an optionally substituted alicyclic group having from 5 to 8 carbon atoms (e.g., cyclopentyl, cyclohexyl), an optionally substituted aralkyl group having from 7 to 12 carbon atoms (e.g., benzyl, phenethyl, chlorobenzyl, methoxybenzyl), an optionally substituted aromatic group having from 6 to 12 carbon atoms (e.g., phenyl, naphthyl, chlorophenyl, tolyl, methoxyphenyl, methoxycarbonylphenyl, dichlorophenyl) or —O—$R^{A'}$(in which $R^{A'}$ represents a hydrocarbon group and, for example, has the same meaning as the hydrocarbon group described for $R^{A1}$, $R^{A2}$ and $R^{A3}$).

When $L^A$ represents

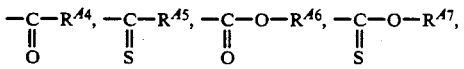

or —S—$R^{A8}$; $R^{A4}$, $R^{A5}$, $R^{A6}$, $R^{A7}$ and $R^{A8}$ each preferably represents an optionally substituted linear or branched alkyl group having from 1 to 12 carbon atoms (e.g., methyl, trichloromethyl, trifluoromethyl, methoxymethyl, ethyl, propyl, n-butyl, hexyl, 3-chloropropyl, phenoxymethyl, 2,2,2-trifluoroethyl, t-butyl, hexafluoro-i-propyl, octyl, decyl), an optionally substituted aralkyl group having from 7 to 12 carbon atoms (e.g., benzyl, phenethyl, methylbenzyl, trimethylbenzyl, pentamethylbenzyl, methoxybenzyl), or an optionally substituted aryl group having from 6 to 12 carbon atoms (e.g., phenyl, nitrophenyl, cyanophenyl, methanesulfonylphenyl, methoxyphenyl, butoxyphenyl, chlorophenyl, dichlorophenyl, trifluoromethylphenyl).

When $L^A$ represents

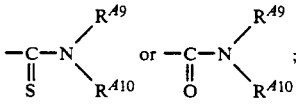

$R^{A9}$ and $R^{A10}$ may be the same or different, and preferred examples of the groups may be selected from the substituents described for $R^{A4}$ to $R^{AS}$.

Other preferred thiol group-producing functional group-containing resins for use in the present invention are resins having at least one thiirane ring, as represented by the following general formula (II) or (III):

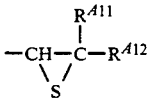

(II)

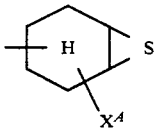

(III)

In the formula (II), $R^{A11}$ and $R^{A12}$ may be the same or different and each represents a hydrogen atom or a hydrocarbon group. Preferred examples of the groups may be selected from the substituents preferred for $R^{A4}$ to $R^{A7}$.

In the formula (III), $X^A$ represents a hydrogen atom or an aliphatic group. The aliphatic group preferably includes an alkyl group having from 1 to 6 carbon atoms (e.g., methyl, ethyl, propyl, butyl).

Still other preferred thiol group-producing functional group-containing resins for use in the present invention are resins containing at least one sulfur atom-containing heterocyclic group, as represented by the following general formula (IV).

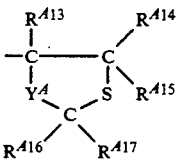

(IV)

In the formula (IV), $y^A$ represents an oxygen atom or —NH—.

$R^{A13}$, $R^{A14}$ and $R^{A15}$ may be the same or different and each represents a hydrogen atom or a hydrocarbon group. Preferably, these each represent a hydrogen atom or the group preferred for $R^{A4}$ to $R^{A7}$.

$R^{A16}$ and $R^{A17}$ may be the same or different and each represents a hydrogen atom, a hydrocarbon group or —O—$R^{A''}$ (in which $R^{A''}$ represents a hydrocarbon group). Preferably, these each represents the group preferred for $R^{A1}$ to $R^{A3}$.

In accordance with this embodiment of the present invention, more preferably the thiol group-producing functional group-containing resins for use in the present invention are resins having at least one functional group composed of art least two thiol groups which are stereostructurally adjacent each other and are protected by one protective group.

Examples of functional groups composed of at least two thiol groups which are stereostructurally adjacent each other and are protected by one protective group, are the following groups of formulae (V), (VI) and (VII)

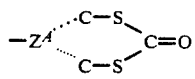

(V)

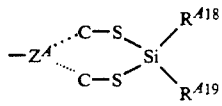

(VI)

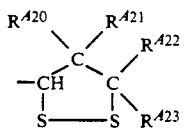

(VII)

In the formulae (V) and (VI), $Z^A$ represents an optionally hetero atom-interrupted carbon-carbon linkage or represents a chemical bond directly bonding the two C-S bonds in the formulae, provided that the number of the atoms between the sulfur atoms is 4 or less. Further, one of the -($Z^A$ . . . C)- bonds may represent only a mere bond, for example, as follows.

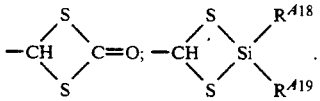

In the formula (VI), $R^{A18}$ and $R^{A19}$ may be the same or different and each represents a hydrogen atom, a hydrocarbon group or —O—$R^{A''}$ (in which $R^{A''}$ represents a hydrocarbon group).

Preferably, $R^{A18}$ and $R^{A19}$ may be the same or different and each represents a hydrogen atom, an optionally substituted alkyl group having from 1 to 12 carbon atoms (e.g., methyl, ethyl, propyl, butyl, hexyl, 2-methoxyethyl, octyl), an optionally substituted aralkyl group having from 7 to 12 carbon atoms (e.g., benzyl phenetyl, methylbenzyl, methoxybenzyl, chlorobenzyl), an alicyclic group having from 5 to 8 carbon atoms (e.g., cyclopentyl, cyclohexyl), an optionally substituted aryl group having from 6 to 12 carbon atoms (e.g., phenyl, chlorophenyl, methoxyphenyl, methylphenyl, cyanophenyl) or —O—$R^{A''}$ (in which $R^{A''}$ represents a hydrocarbon group which may be the same as the group for $R^{A18}$ and $R^{A19}$).

In the formula (VII), $R^{A20}$, $R^{A21}$, $R^{A22}$ and $R^{A23}$ may be the same or different and each represents a hydrogen atom or a hydrocarbon group. Preferably, each represents a hydrogen atom or a hydrocarbon group which may be the same as the group preferred for $R^{A18}$ and $R^{A19}$.

The resins containing at least one functional group represented by any of the formulae (I) to (VII) for use in the present invention can be prepared by protecting the thiol group(s) in a thiol group-containing polymer with a protective group by polymer reaction or by polymerizing a monomer having one or more protected thiol groups or copolymerizing the monomer with other copolymerizable monomer(s).

It is difficult to directly polymerize a thiol group-containing monomer, since the thiol group of the monomer interferes with radical polymerization. Accordingly, the thiol group may be introduced into a thiol group-free polymer by polymer reaction; or alternatively, the thiol group in the monomer to be polymerized is previously protected to a protected functional group, for example, in the form of a isothiuronium salt or Bunte salt, the thus protected monomer is polymerized and then the resulting polymer is subjected to a decomposition reaction to decompose the protected thio group into a free thiol group.

The method of producing the thiol group-containing polymers for use in the present invention, in which a monomer containing one or more functional groups of any of the formulae (I) to (VII) is polymerized or copolymerized, is therefore preferred, because polymers having one or more functional groups of protected thiol groups may freely be prepared, no impurities are introduced into the polymers formed and monomers having free (or unprotected) thiol group(s) are hardly polymerized.

For conversion of one or at least two thiol groups into one or more protected functional groups, for example, the methods described in the literature in Iwakura and K. Kurita, *Hanno-sei Kobunshi* (*Reactive Polymers*), pages 230 to 237 (published by Kodan-sha, 1977); *Shin-jikken Kagaku Koza* (*New Lecture of Experimental Chemistry*), Vol. 14, Synthesis and Reaction of Organic Compounds (III), Chap. 8, pages 1700 to 1713 (edited by Nippon Kagaku-kai and published by Maruzen, 1978); J. F. W. McOmie, *Protective Groups in Organic Chemistry*, Chap. 7 (published by Plenum Press, 1973); or S. Patai, *The Chemistry of the Thiol Group*, Part 2, Vol. 12, Chap. 14 (published by John Wiley & Sons, 1974) may be employed.

Monomers having one or more protected thiol groups, for example, those having one or more functional groups of the formulae (I) to (VII), can be prepared by converting the thiol group(s) in compounds having a polymerizable double bond and having at least one thiol group into the functional group(s) of the formulae (I) to (VII), for example, in accordance with the methods described in the literature above or by reacting a compound containing one or more functional groups of the formulae (I) to (VII) and a compound having a polymerizable double bond.

Specific examples of repeating units having one or more functional groups of the formulae (I) to (VII) are the following compounds, which, however, are not to be construed whatsoever as limitative.

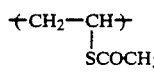

(1)

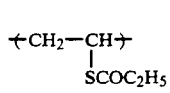

(2)

-continued
(3)
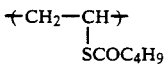
(4)
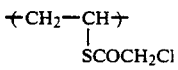
(5)
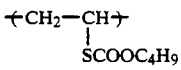
(6)
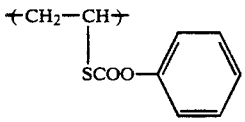
(7)
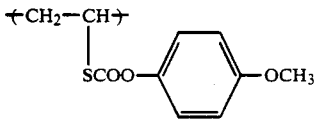
(8)
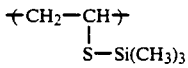
(9)
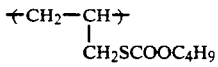
(10)
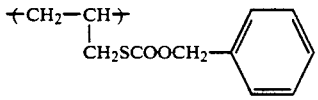
(11)
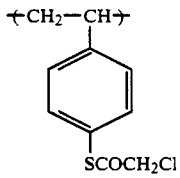
(12)
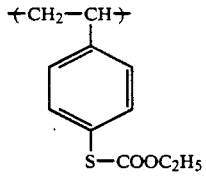
(13)
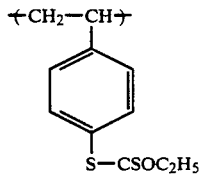
(14)
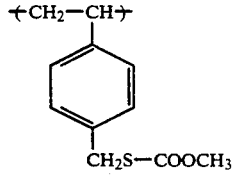
-continued
(15)
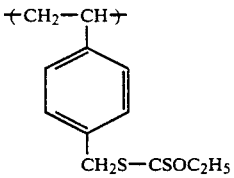
(16)
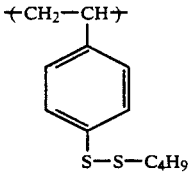
(17)
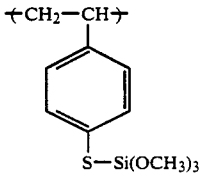
(18)
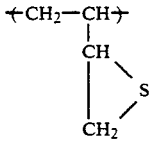
(19)
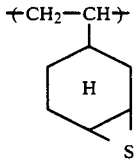
(20)
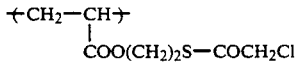
(21)
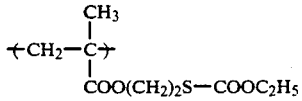
(22)
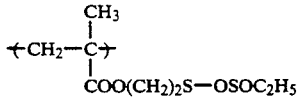
(23)
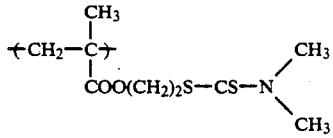
(24)
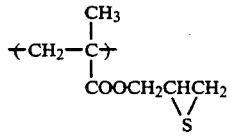
(25)
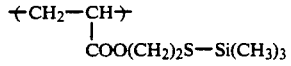

-continued
(26)
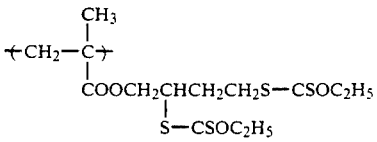
(27)
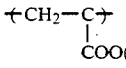
(28)
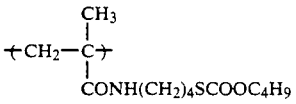
(29)
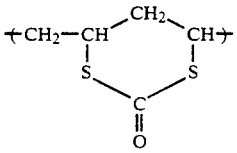
(30)
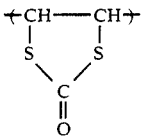
(31)
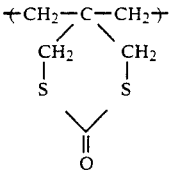
(32)
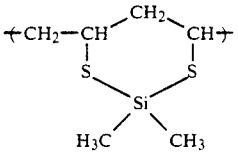
(33)
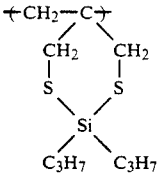
(34)
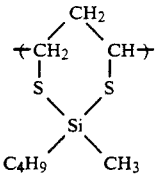
(35)
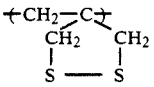
(36)
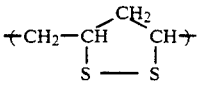
-continued
(37)
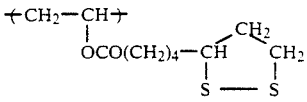
(38)
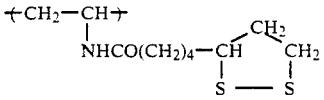
(39)
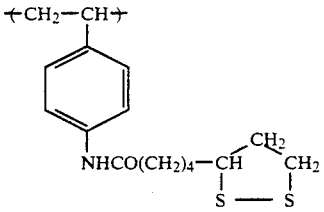
(40)
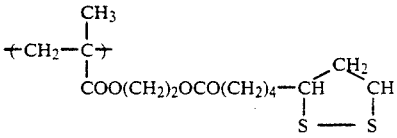
(41)
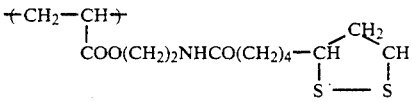
(42)
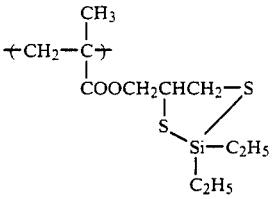
(43)
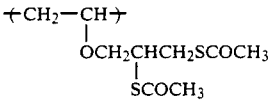
(44)
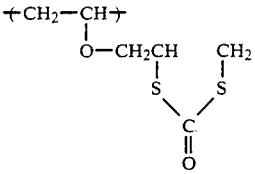
(45)
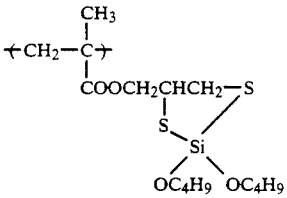
(46)
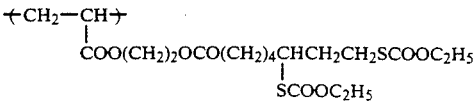
(47)
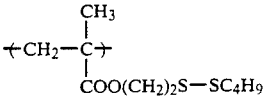

-continued

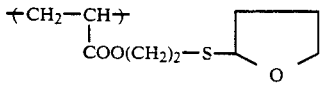
(48)

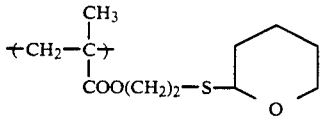
(49)

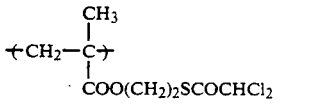
(50)

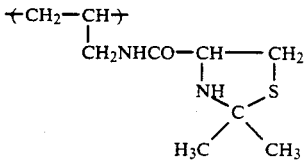
(51)

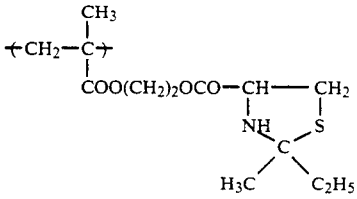
(52)

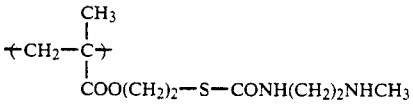
(53)

Resins containing functional group(s) capable of forming a phosphono group, such as those of the following formula (VIII) or (IX), by decomposition, which can be used in the present invention, are explained in detail hereunder.

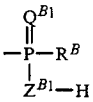
(VIII)

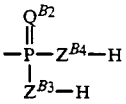
(IX)

In the formulae (VIII), $R^B$ represents a hydrocarbon group or $—Z^{B2}-R^{B'}$ (in which $R^{B'}$ represents a hydrocarbon group, and $Z^{B2}$ represents an oxygen atom or a sulfur atom). $Q^{B1}$ represents an oxygen atom or a sulfur atom. $Z^{B1}$ represents an oxygen atom or a sulfur atom. In the formula (IX), $Q^{B2}$, $Z^{B3}$ and $Z^{B4}$ independently represent an oxygen atom or a sulfur atom.

Preferably, $R^B$ represents an optionally substituted linear or branched alkyl group having from 1 to 12 carbon atoms (e.g., methyl, ethyl, propyl, butyl, pentyl, hexyl, octyl, decyl, 2-methoxyethyl, 3-methoxy-propyl, 2-ethoxyethyl), an optionally substituted alicyclic group having from 5 to 8 carbon atoms (e.g., cyclopentyl cyclohexyl), an optionally substituted aralkyl group having from 7 to 12 carbon atoms (e.g., benzyl, phenethyl, methylbenzyl, methoxybenzyl, chlorobenzyl), an optionally substituted aromatic group having from 6 to 12 carbon atoms (e.g., phenyl, chlorophenyl, tolyl, xylyl, methoxyphenyl, methoxycarbonylphenyl, dichlorophenyl) or $—Z^{B2}-R^{B'}$ (where $Z^{B2}$ represents an oxygen atom or a sulfur atom, and $R^{B'}$ represents a hydrocarbon group, examples of which include the hydrocarbon groups mentioned for $R^B$).

$Q^{B1}$, $Q^{B2}$, $Z^{B1}$, $Z^{B3}$ and $Z^{B4}$ independently represent an oxygen atom or a sulfur atom.

Examples of the functional groups capable of forming the phosphono group represented by the formula (VIII) or (IX) by decomposition are those represented by the following formulae (X) and/or (XI).

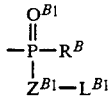
(X)

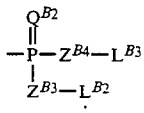
(XI)

In the formulae (X) and (XI), $Q^{B1}$, $Q^{B2}$, $Z^{B1}$, $Z^{B3}$ $Z^{B4}$ and $R^B$ have the same meanings as those defined for the formulae (VIII) and (IX).

$L^{B1}$, $L^{B2}$ and $L^{B3}$ independently represent

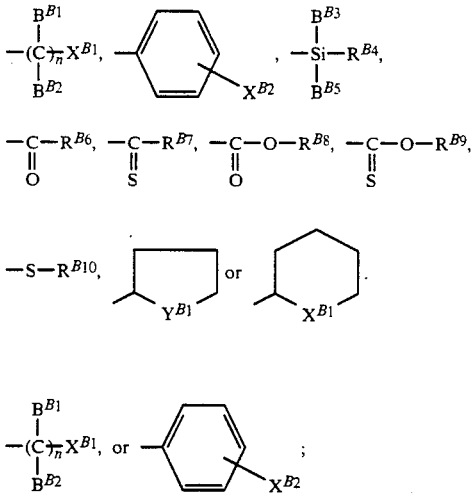

$R^{B1}$ and $R^{B2}$ may be the same or different and each represents a hydrogen atom, a halogen atom (e.g., chlorine, bromine, fluorine) or a methyl group. $X^{B1}$ and $X^{B2}$ each represents an electron-attracting substituent (which means a substituent whose Hammett's substituent constant is positive, such as halogen atoms, —COO—,

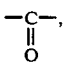

$—SO_2—$, —CN, $—NO_2$, etc.), preferably a halogen atom (e.9., chlorine, bromine, fluorine), —CN, $—CONH_2$, $—NO_2$ or $—SO_2R^{B''}$ (in which $R^{B''}$ represents a hydrocarbon group such as methyl, ethyl, propyl, butyl, hexyl, benzyl, phenyl, tolyl, xylyl or mesityl). n represents 1 or 2. When $X^{B1}$ is methyl group, $R^{B1}$ and $R^{B2}$ both are methyl groups and n is 1.

When $L^{B1}$ to $L^{B2}$ each represents

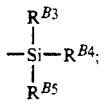

$R^{B3}$, $R^{B4}$ and $R^{B5}$ may be the same or different and each preferably represents a hydrogen atom, an optionally substituted linear or branched alkyl group having from 1 to 18 carbon atoms (e.g., methyl, ethyl, propyl, butyl, hexyl, octyl, decyl, dodecyl, octadecyl, chloroethyl, methoxyethyl, methoxypropyl), an optionally substituted alicyclic group having from 5 to 8 carbon atoms (e.g., cyclopentyl cyclohexyl), an optionally substituted aralkyl group having from 7 to 12 carbon atoms (e.g., benzyl, phenethyl, chlorobenzyl, methoxybenzyl), an optionally substituted aromatic group having from 6 to 12 carbon atoms (e.g., phenyl, naphthyl, chlorophenyl, tolyl, methoxyphenyl, methoxycarbonylphenyl, dichlorophenyl) or —O—$R^{B''}$ (in which $R^{B''}$ represents a hydrocarbon group, examples of which include the hydrocarbon groups described for $R^{B3}$, $R^{B4}$ and $R^{B5}$).

When $L^{B1}$ to $L^{B2}$ each represents

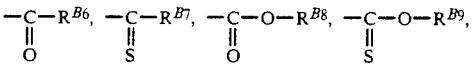

or —S—$R^{B10}$; $R^{B6}$, $R^{B7}$, $R^{B8}$, $R^{B9}$ and $R^{B10}$ independently represent a hydrocarbon group, preferably an optionally substituted linear or branched alkyl group having from 1 to 6 carbon atoms (e.g., methyl, trichloromethyl, trifluoromethyl, methoxymethyl, phenoxymethyl, 2,2,2-trifluoroethyl, ethyl, propyl, hexyl, t-butyl, hexafluoro-i-propyl), an optionally substituted aralkyl group having from 7 to 12 carbon atoms (e.g., benzyl, phenethyl, methylbenzyl, trimethylbenzyl, pentamethylbenzyl, methoxybenzyl or an optionally substituted aryl group having from 6 to 12 carbon atoms (e.g., phenyl, tolyl, xylyl, nitrophenyl, cyanophenyl, methanesulfonylphenyl, methoxyphenyl, butoxyphenyl, chlorophenyl, dichlorophenyl, trifluoromethylphenyl).

When $L^{B1}$ to $L^{B2}$ each represents

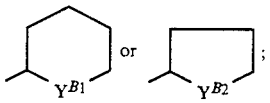

$Y^{B1}$ and $Y^{B2}$ each represents an oxygen atom or a sulfur atom.

The resins having at least one functional group for use in the present invention can be prepared by a method of protecting the hydrophilic group (phosphono group) of the aforesaid formula (VIII) or (IX) in a polymer by a protective group by polymer reaction, or by a method of polymerizing a monomer having a previously protected functional group (for example, the functional group of formula (X) or (XI)) or copolymerizing the monomer with a copolymerizable monomer.

In any of these methods, the same synthesizing reaction may be employed to introduce the protective group. Briefly, the resins for use in the present invention can be prepared by the method described in the literature as referred to in J. F. W. McOmie, *Protective Groups in Organic Chemistry*, Chap. 6 (published by Plenum Press, 1973), or in accordance with the same synthesizing reaction as the method of introducing a protective group into the hydroxyl group in a polymer described in literature of *Shin-jikken Kagaku Koza* (*New Lecture of Experimental Chemistry*), Vol. 14, Synthesis and Reaction of Organic Compounds (V), page 2497 (published by Maruzen, 1978) or also in accordance with the same synthesizing reaction as the method of introducing a protective group into the thiol group in a polymer described in literature of S. Patai, *The Chemistry of the Thiol Group, Part* 2, Vol. 13, Chap. 14 (published by Wiley-Interscience, 1974) or T. W. Greene, *Protective Groups in Organic Synthesis*, Chap. 6 (published by Wiley-Interscience, 1981).

Examples of compounds suitable as repeating units of the polymer components containing the functional groups of the formulae (X) and/or (XI) as protective groups are shown below, which, however, are not intended to restrict the scope of the present invention.

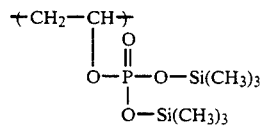

(54)

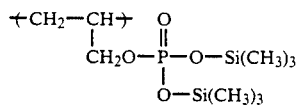

(55)

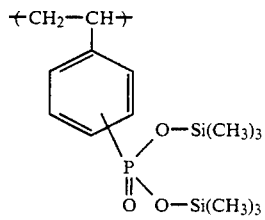

(56)

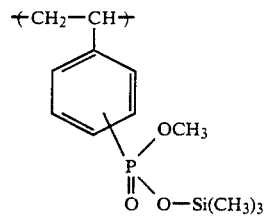

(57)

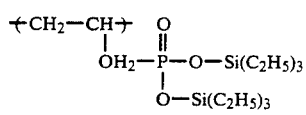

(58)

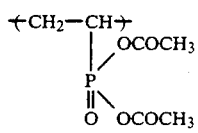

(59)

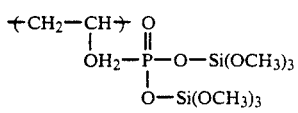

(60)

-continued
(61)
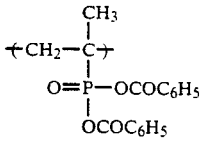
(62)
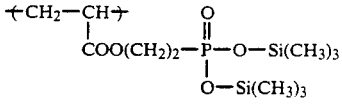
(63)
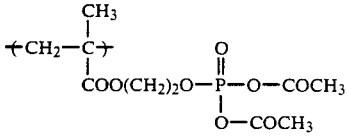
(64)
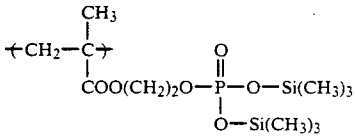
(65)
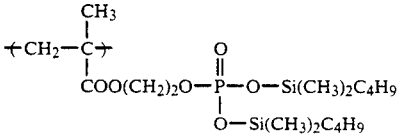
(66)
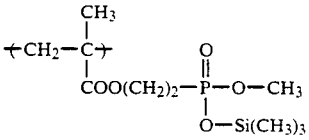
(67)
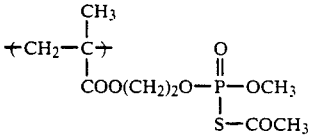
(68)
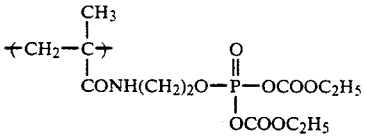
(69)
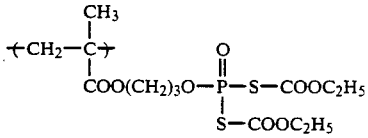
(70)
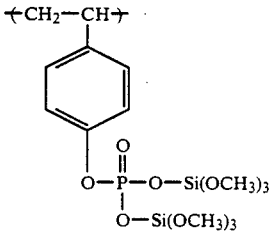
-continued
(71)
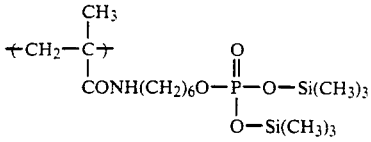
(72)
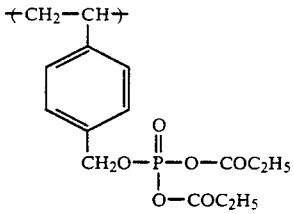
(73)
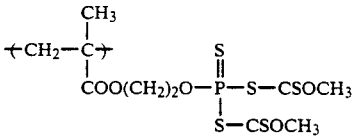
(74)
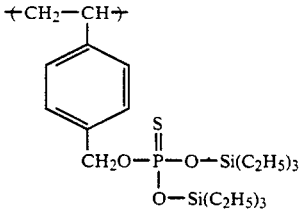
(75)
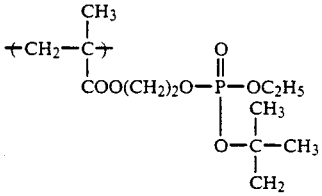
(76)
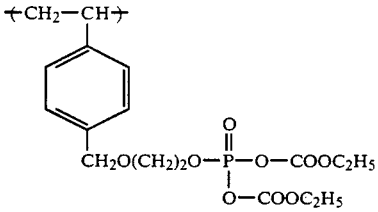
(77)
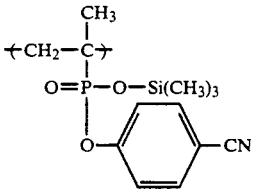
(78)
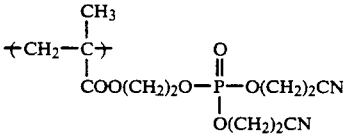
Functional groups capable of forming amino group(s), such as $-NH_2$ group and/or $-NHR^{C0}$ group, for example, are groups as represented by any of the following general formulae (XII) to (XIV).

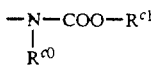

(XII)

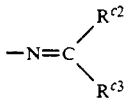

(XIII)

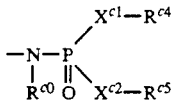

(XIV)

In the formulae (XII) and (XIV), $R^{C0}$ represents a hydrogen atom, an optionally substituted alkyl group having from 1 to 12 carbon atoms (e.g., methyl, ethyl, propyl, butyl, hexyl, octyl, decyl, dodecyl, 2-chloroethyl, 2-bromoethyl, 2-chloropropyl, 2-cyanoethyl, 2-methoxyethyl, 2-ethoxyethyl, 2-methoxycarbonylethyl, 3-methoxypropyl, 6-chlorohexyl), an alicyclic group having from 5 to 8 carbon atoms (e.g., cyclopentyl, cyclohexyl), an optionally substituted aralkyl group having from 7 to 12 carbon atoms (e.g., benzyl, phenethyl, 3-phenylpropyl, 1-phenylpropyl, chlorobenzyl, methoxybenzyl, bromobenzyl, methylbenzyl) or an optionally substituted aryl group having from 6 to 12 carbon atoms (e.g., phenyl, chlorophenyl, dichlorophenyl, tolyl, xylyl, mesityl, chloromethyl, chlorophenyl, methoxyphenyl, ethoxyphenyl, chloromethoxyphenyl).

When $R^{C0}$ represents a hydrocarbon group, such preferably has from 1 to 8 carbon atoms.

In the functional group of formula (XII, $R^{C1}$ represents an optionally substituted aliphatic group having from 2 to 12 carbon atoms, more specifically group of the following formula (XV):

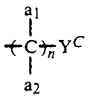

(XV)

where $a_1$ and $a_2$ each represents a hydrogen atom, a halogen atom (e.g., chlorine, fluorine) or an optionally substituted hydrocarbon group having from 1 to 12 carbon atoms (e.g., methyl, ethyl, propyl, butyl, hexyl, methoxyethyl, ethoxymethyl, 2-methoxyethyl, 2-chloroethyl, 3-bromopropyl, cyclohexyl, benzyl, chlorobenzyl, methoxybenzyl, methylbenzyl, phenethyl, 3-phenylpropyl, phenyl, tolyl, xylyl, mesityl, chlorophenyl, methoxyphenyl, dichlorophenyl, chloromethylphenyl, naphthyl); $Y^C$ represents a hydrogen atom, a halogen atom (e.g., fluorine, chlorine), a cyano group, an alkyl group having from 1 to 4 carbon atoms (e.g., methyl, .ethyl, propyl, butyl), an optionally substituted aromatic group having 6 to 12 carbon atoms (e.g., phenyl, tolyl, cyanophenyl, 2,6-dimethylphenyl, 2,4,6-trimethylphenyl, pentamethylphenyl, 2,6-dimethoxyphenyl, 2,4,6-trimethoxyphenyl, 2-propylphenyl, 2-butylphenyl, 2-chloro-6-methylphenyl, furanyl) or $-SO_2-R^{C6}$ (in which $R^{C6}$ has the same meaning as the hydrocarbon group of $Y^C$); and n represents 1 or 2.

More preferably, when $Y^C$represents a hydrogen atom or an alkyl group, $a_1$ and $a_2$ on the carbon atom adjacent to the oxygen atom of the urethane bond are substituents other than a hydrogen atom.

When $Y^C$ is not a hydrogen atom or an alkyl group, $a_1$ and $a_2$ may be any of the above-mentioned groups. Specifically, $R^{C1}$ of

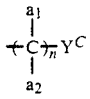

forms a group containing at least one or more electron-attracting groups or is a group in which the carbon adjacent to the oxygen atom of the urethane bond forms a stereostructurally high bulky group, as preferred examples.

Alternatively, $R^{C1}$ represents an alicyclic group, for example, a mono-cyclic hydrocarbon group (e.g., cyclopropyl, cyclobutyl, cyclopentyl, cyclohexyl, 1-methyl-cyclohexyl, 1-methylcyclobutyl) or a cross-linked cyclic hydrocarbon group (e.g., bicyclooctane, bicyclooctene, bicyclononane, tricycloheptane).

In the formula (XIII), $R^{C2}$ and $R^{C3}$ may be the same or different and each represents a hydrocarbon group having from 1 to 12 carbon atoms, for example, an aliphatic group or an aromatic group such as the group of $Y^C$ in the formula (XII).

In the formula (XIV), $X^{C1}$ and $X^{C2}$ may be the same or different and each represents an oxygen atom or a sulfur atom. $R^{C4}$ and $R^{C5}$ may be the same or different and each represents a hydrocarbon group having from 1 to 8 carbon atoms, for example, an aliphatic group or an aromatic group such as the group of $Y^C$ in the formula (XII).

Specific examples of the functional groups of the formulae (XII) to (XIV) are mentioned below, which, however, are not intended to restrict the scope of the present invention.

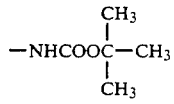

(79)

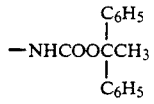

(80)

$-NHCOOCH_2CF_3$ (81)

$-NHCOOCH_2CCl_3$ (82)

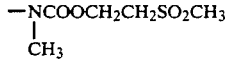

(83)

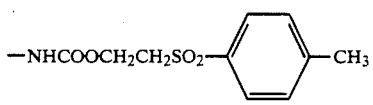

(84)

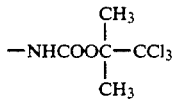

(85)

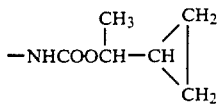

(86)

-continued (87)

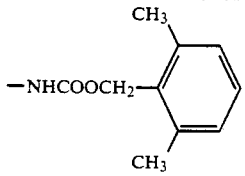

(88)

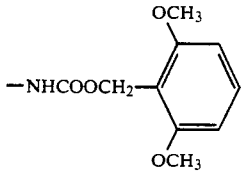

(89)

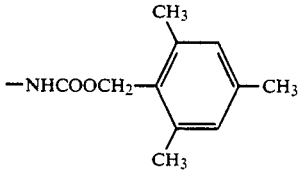

(90)

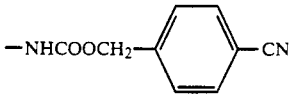

(91)

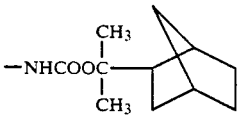

(92)

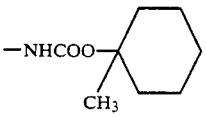

(93)

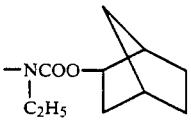

(94)

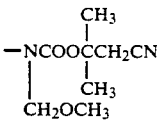

(95)

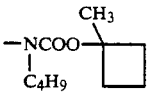

(96)

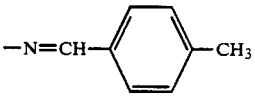

(97)

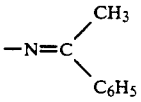

(98)

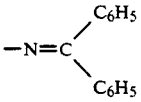

-continued (99)

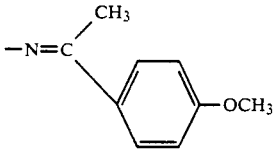

(100)

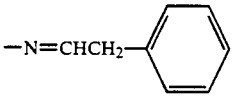

(101)

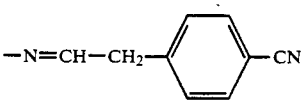

(102)

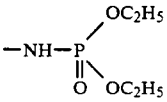

(103)

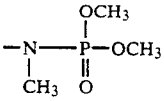

(104)

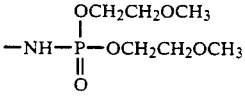

(105)

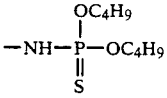

Resins having at least one functional group capable of forming an amino group (for example $—NH_2$ and/or $—NHR^{C0}$) by decomposition, for example, at least one functional group selected from the groups of the aforesaid formulae (XII) to (XIV), for use in the present invention can be prepared, for example, in accordance with the methods described in the literature as referred to in *Shin-jikken Kagaku Koza* (*New Lecture of Experimental Chemistry*), Vol. 14, page 2555 published by Maruzen), J. F. W. McOmie, *Protective Groups in Organic Chemistry*, Chap. 2 (published by Plenum Press, 1973) or *Protective Groups in Organic Synthesis*, Chap. 7 (published by John Wiley & Sons, 1981).

The method of preparing the resins from monomers previously containing the functional group of any one of the formulae (XII) to (XIV) by polymerization reaction is preferred, because polymers having the functional group of any one of the formulae (XII) to (XIV) may freely be prepared or no impurities are introduced into the polymers formed. Specifically, the primary or secondary amino group in a primary or secondary amine containing a polymerizable double bond is converted into a functional group of any one of the formulae (XII) to (XV) in accordance with the method described in the above literature, and then the resulting amine is polymerized.

Examples of the functional group capable of forming at least one sulfo group ($—SO_3H$) by decomposition includes functional groups of the following formulae (XVI) or (XVII).

$$-SO_2-O-R^{D1} \quad \text{(XVI)}$$

$$-SO_2-S-R^{D2} \quad \text{(XVII)}$$

In the formula (XVI), $R^{D1}$ represents

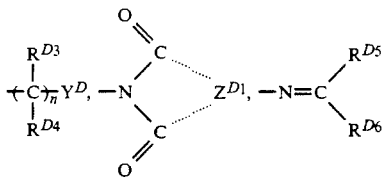

or $-NHCOR^{D7}$.

In the formula (XVII), $R^{D2}$ represents an optionally substituted aliphatic group having from 1 to 18 carbon atoms or an optionally substituted aryl group having from 6 to 22 carbon atoms.

The functional group as represented by the formula (XVI) or (XVII) forms a sulfo group by decomposition, and this is explained in detail hereunder.

When $R^{D1}$ represents

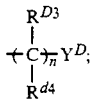

$R^{D3}$ and $R^{D4}$ may be the same or different and each represents a hydrogen atom, a halogen atom (e.g., fluorine, chlorine, bromine), an alkyl group having from 1 to 6 carbon atoms (e.g., methyl, ethyl, propyl, butyl, pentyl, hexyl) or aryl group having from 6 to 12 carbon atoms (e.g., phenyl). $Y^D$ represents an optionally substituted alkyl group having from 1 to 18 carbon atoms (e.g., methyl, ethyl, propyl, butyl, pentyl, hexyl, octyl, decyl, dodecyl, hexadecyl, trifluoromethyl, methanesulfonylmethyl, cyanomethyl, 2-methoxyethyl, ethoxymethyl, chloromethyl, dichloromethyl, trichloromethyl, 2-methoxycarbonylethyl, 2-propoxycarbonylethyl, methylthiomethyl, ethylthiomethyl), an optionally substituted alkenyl group having from 2 to 18 carbon atoms (e.g., vinyl, allyl), an optionally substituted aryl group having from 6 to 12 carbon atoms (e.g., phenyl, naphthyl, nitrophenyl, dinitrophenyl, cyanophenyl, trifluoromethylphenyl, methoxycarbonylphenyl, butoxycarbonylphenyl, methanesulfonylphenyl, benzenesulfonylphenyl, tolyl, xylyl, acetoxyphenyl, nitronaphthyl) or

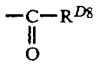

(in which $R^{D8}$ represents an aliphatic group or an aromatic group, examples of which include the groups described for group $Y^D$. n represents 0, 1 or 2.

More preferably, the substituent

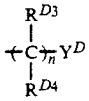

is a functional group containing at least one electron-attracting group. Specifically, when n is 0 and $Y^D$ is a hydrocarbon group containing no electron-attracting group, the substituent

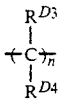

contains at least one or more halogen atoms. Alternatively, n is 0, 1 or 2, and $Y^D$ contains at least one electron-attracting group. Further, n is 1 or 2, and the group

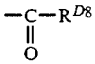

corresponds to

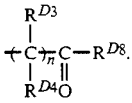

The electron-attracting group means a substituent having a positive Hammett's substituent constant, for example, including a halogen atom —COO—,

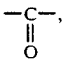

$-SO_2-$, —CN, $-NO_2$ and the like.

A still another preferred substituent of $-SO_2-O-R^{D1}$ is one where the carbon atom adjacent to the oxygen atom in the formula is substituted by at least two hydrocarbon groups, or when n is 0 or 1 and $Y^D$ is an aryl group, the 2-position and 6-position of the aryl group have substituents.

When $R^{D1}$ represents

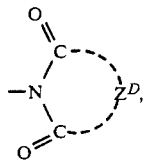

$Z^D$ represents an organic residue forming a cyclic imido group. Preferably, this represents an organic group of the following formulae (XVIII) or (XIX).

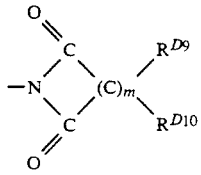

(XVIII)

-continued

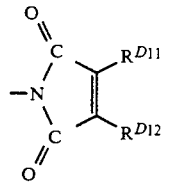

(XIX)

In the formulas (XVIII) and (XIX , $R^{D9}$, $R^{D10}$, $R^{D11}$ and $R^{D12}$ may be the same or different and each represents a hydrogen atom, a halogen atom (e.g., chlorine, bromine), an optionally substituted alkyl group having from 1 to 18 carbon atoms (e.g., methyl, ethyl, propyl, butyl, hexyl, octyl, decyl, dodecyl, hexadecyl, octadecyl, 2-chloroethyl, 2-methoxyethyl, 2-cyanoethyl, 3-chloropropyl, 2-(methanesulfonyl)ethyl, 2-(ethoxyoxy)ethyl), an optionally substituted aralkyl group having from 7 to 12 carbon atoms (e.g., benzyl, phenethyl, 3-phenylpropyl, methylbenzyl, dimethylbenzyl, methoxybenzyl, chlorobenzyl, bromobenzyl) or an optionally substituted alkenyl group having from 3 to 18 carbon atoms (e.g., allyl, 3-methyl-2-propenyl).

When $R^{D1}$ represents

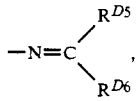

$R^{D5}$ and $R^{D6}$ each represents a hydrogen atom, an aliphatic group (examples of which include those for $R^{D3}$ and $R^{D4}$) or an aryl group (examples of which include those for $R^{D3}$ and $R^{D4}$), provided that both $R^{D5}$ and $R^{D6}$ must not be hydrogens at the same time.

When $R^{D1}$ represents —NHCO$R^{D7}$, $R^{D7}$ represents an aliphatic group or an aryl group, examples of which include those for $R^{D3}$ and $R^{D4}$.

In the formula (XVII), $R^{D2}$ represents an optionally substituted aliphatic group having from 1 to 18 carbon atoms or an optionally substituted aryl group having from 6 to 22 carbon atoms.

More specifically, $R^{D}{}_2$ in the formula (XVII) represents an aliphatic group or an aryl group, examples of which include those for $Y^D$ in the formula (XVI).

The resins containing at least one functional group selected from the groups consisting of (—$SO_2$—O—$R^{D1}$) and (—$SO_2$—O—$R^{D2}$), for use in the present invention, can be prepared by a method of converting the sulfo group in a polymer into a functional group of the formula (XVI) or (XVII) by polymer reaction, or by a method of polymerizing one or more monomers containing one or more functional groups of the formula (XVI) or (XVII) or copolymerizing the monomer and a copolymerizable monomer.

The method of converting the sulfo group into the functional group can be conducted in the same manner for preparing the functional group-containing monomers, also in a polymer reaction.

Specific examples of the functional groups of the formulae (XVI) —$SO_2$—O—$R^{D1}$ and (XVII) —$SO_2$—S—$R^{D2}$ are the following groups, which, however, are not intended to restrict the scope of the present invention.

(106)

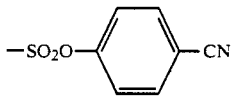

(107)

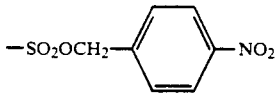

$-SO_2OCH_2CF_3$ (108)

(109)

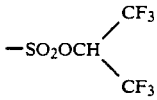

$-SO_2OCH_2(CHF)_2CH_2F$ (110)

$-SO_2OCH_2CCl_3$ (111)

(112)

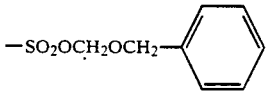

$-SO_2O(CH_2)_2SO_2C_4H_9$ (113)

(114)

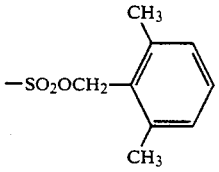

(115)

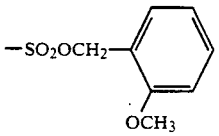

(116)

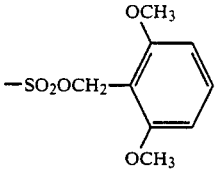

(117)

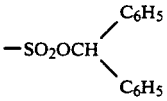

(118)

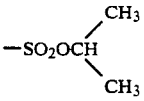

(119)

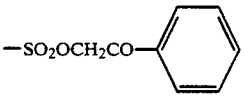

(120)

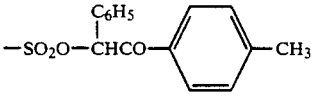

-continued (121) 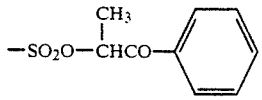

(122) $-SO_2O-CH(C_6H_5)-COC_4H_9$ (123) $-SO_2O(CH_2)_2SO_2C_2H_5$ (124) $-SO_2SC_4H_9$ (125) $-SO_2SC_6H_{13}$ (126) $-SO_2S(CH_2)_2OC_2H_5$ (127) 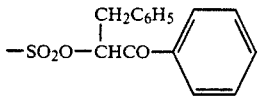

(128) $-SO_2OCH_2CHFCH_2F$ (129) 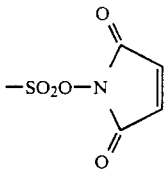

(130) 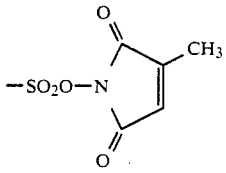

(131) 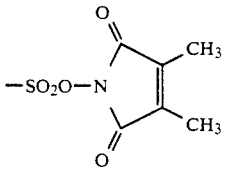

(132) 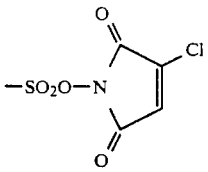

(133) 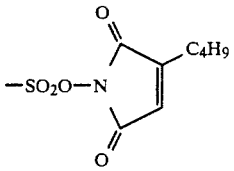

(134) 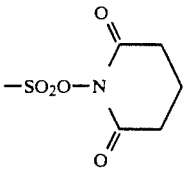

-continued (135) 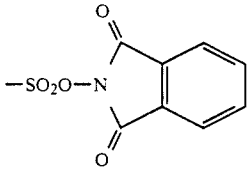

(136) 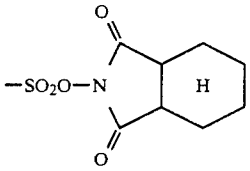

(137) 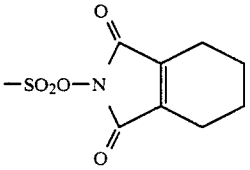

(138) 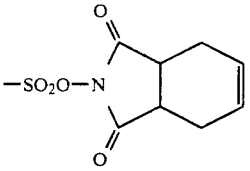

Specific, but not limiting, examples of the copolymer constituents containing the functional groups of the general formula (I) to (VII), (X) to (XIV), (XVI) and (XVII), used in the method of preparing a desired resin through the polymerization reaction according to the third preferred embodiment of the present invention as described above, include those represented by the following general formula (A):.

(A) 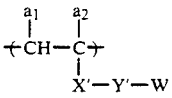

wherein X' represents —O—, —CO—, —COO—, —OCO—,

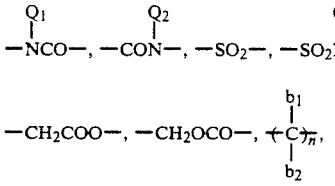

an aromatic group, or a heterocyclic group (wherein $Q_1$, $Q_2$, $Q_3$ and $Q_4$ each represent a hydrogen atom, a hydrocarbon group or the moiety —Y'—W in the formula (VI); $b_1$ and $b_2$ may be the same or different, each being a hydrogen atom, a hydrocarbon group or the moiety —Y'—W in the formula (VI); and n is an integer of from 0 to 18); Y' represents a carbon-carbon bond for connecting the linkage group X' to the functional group —W, between which hetero atoms (including oxygen, sulfur and nitrogen atoms) may be present, which specific examples are

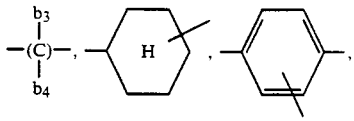

—(CH=CH)—, —O—, —S—,

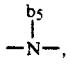

—COO—, —CONH—, —$SO_2$—, —$SO_2NH$—, —NHCOO—, and —NHCONH—, individually or in combination (wherein $b_3$, $b_4$ and $b_5$ each have the same meanings as the foregoing $b_1$ and $b_2$); W represents the functional group represented by the formulae (I) to (VII), (X) to XIV), (XVI) or (XVII); and $a_1$ and $a_2$ may be the same or different, each being a hydrogen atom, a halogen atom (e.g., chlorine, bromine atom), a cyano group, a hydrocarbon residue (e.g., an optionally substituted alkyl group containing 1 to 12 carbon atoms, such as methyl, ethyl, propyl, butyl, methoxycarbonyl, ethoxycarbonyl, propoxycarbonyl, butoxycarbonyl, hexyloxycarbonyl, methoxycarbonylmethyl, ethoxycarbonylmethyl, butoxycarbonylmethyl, etc., an aralkyl group such as benzyl, phenethyl, etc., and an aryl group such as phenyl; tolyl, xylyl, chlorophenyl, etc.), or an alkyl group containing 1 to 18 carbon atoms, an alkenyl group, an aralkyl group, an alicyclic group or an aromatic group, which may be substituted by a substituent containing the moiety —W in the formula (A).

In addition, the linkage moiety —X∝—Y'—in the formula (A) may directly connect the moiety

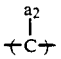

to the moiety —W.

Furthermore, the resins of this embodiment contain not only monomers containing the functional groups of the foregoing general formulae (I) to (VII), (X) to (XIV), (XVI) and/or (XVII), but also other monomers, as copolymer constituents, for example, α-olefins, vinyl or allyl esters of alkanic acids, acrylonitrile, methacrylonitrile, vinyl ethers, acrylamides, methacrylamides, styrenes, heterocyclic vinyl compounds such as vinylpyrrolidone, vinylpyridine, vinylimidazole, vinylthiophene, vinylimidazoline, vinylpyrazole, vinyldioxane, vinylquinone, vinylthiazole, vinyloxazine and the like. Above all, vinyl acetate, allyl acetate, acrylonitrile, methacrylonitrile and styrenes are preferably used from the standpoint of increasing the film strength.

In the resin of the present invention, at least a part of the polymer can be crosslinked. Such a resin that at least a part of the polymer is previously cross-linked (resin having a crosslinked structure in the polymer) is preferably a resin which is hardly soluble or insoluble in acidic or alkaline aqueous solutions when the foregoing polar or hydrophilic group-producing functional group contained in the resin is decomposed to form the polar or hydrophilic group. Specifically, the solubility of the resin in distilled water at 20° to 25° C. is preferably at most 90% by weight, more preferably at most 70% by weight.

Introduction of a crosslinked structure in a polymer can be carried out by known methods, that is, (1) a method comprising incorporating functional groups for effecting a crosslinking reaction in the polymer containing functional groups capable of forming polar or hydrophilic groups through decomposition and crosslinking the polymer containing both the functional groups with various crosslinking agents or hardening agents and (2) a method comprising subjecting the above described polymer to polymerization reaction (i.e., method comprising crosslinking by a high molecular reaction or method comprising effecting the polymerization reaction of a polymer containing at least one monomer corresponding to the polymer constituent containing the functional group capable of forming the polar or hydrophilic group through decomposition in the presence of a multifunctional monomer or multifunctional oligomer containing two or more polymerizable functional groups, thereby effecting crosslinking among the molecules).

In the present invention, the functional group for effecting a crosslinking reaction can be any of ordinary polymerizable double bond groups and reactive groups to be linked by chemical reactions.

Examples of the polymerizable double bond group are:

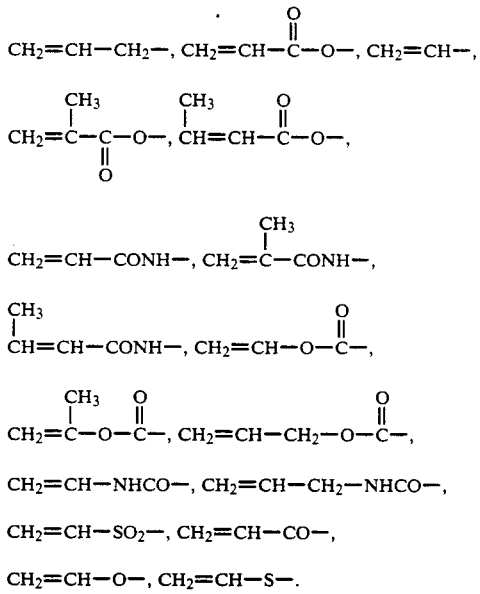

The crosslinking of the polymers by reacting the reactive groups with each other to form chemical bonds can be carried out in the similar manner to the ordinary reactions of organic low molecular compounds, for example, as disclosed in Yoshio Iwakura and Keisuke Kurita "Reactive Polymers (Hannosei Kobunshi)" published by Kohdansha (1977) and Ryohei Oda "High Molecular Fine Chemical (Kobunshi Fine Chemical)" published by Kohdansha (1976). Combination of functional groups classified as Group A (hydrophilic polymeric component) and functional groups classified as Group B (polymers comprising components containing reactive groups) in the following Table 1 has well been known for effectively accomplishing the polymer reactions.

TABLE 1

| Group A | Group B |
|---|---|
| —COOH, —$PO_3H_2$ | 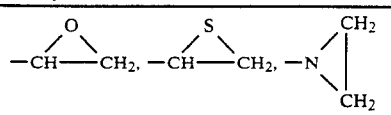 |
| —OH, —SH | —COCl, —$SO_2Cl$, cyclic acid anhydride |
| —$NH_2$ | |
| —$SO_2H$ | —N=C=O, —N=C=S, 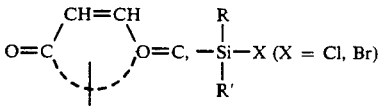 |

In addition, as the reactive group, there can be used —$CONHCH_2OR$ wherein R represents a hydrogen atom or an alkyl group such as methyl, ethyl, propyl or butyl group, which has been known as a group for linking by a self-condensation type reaction.

As the crosslinking agent in the present invention, there can be used compounds commonly used as crosslinking agents, for example, described in Shinzo Yamashita and Tosuke Kaneko "Handbook of Crosslinking Agents (Kakyozai Handbook)" published by Taiseisha (1981) and Kobunshi Gakkai Edition "High Molecular Data Handbook -Basis- (Kobunshi Data Handbook -Kisohen-)" published by Baihunkan (1986).

Examples of the crosslinking agent are organosilane compounds such as vinyltrimethoxysilane, vinyltributoxysilane, γ-glycidoxypropyltrimethoxysilane, Y-mercaptopropyltriethoxysilane, γ-aminopropyltriethoxy silane and other silane coupling agents; polyisocyanate compounds such as tolylene diisocyanate, o-tolylene diisocyanate, diphenylmethane diisocyanate, triphenylmethane diisocyanate, polymethylenepolyphenyl isocyanate, hexamethylene diisocyanate, isophorone diisocyanate, high molecular polyisocyanate; polyol compounds such as 1,4-butanediol, polyoxypropylene glycol, polyoxyalkylene glycol, 1,1,1-trimethylolpropane and the like; polyamine compounds such as ethylenediamine, γ-hydroxypropylated ethylenediamine, phenylenediamine, hexamethylenediamine, N-aminoethylpiperazine, modified aliphatic polyamines and the like; polyepoxy group-containing compounds and epoxy resins, for example, as described in Kakiuchi Hiroshi "New Epoxy Resins (Shin Epoxy Jushi)" published by Shokodo (1985), and Kuniyuki Hashimoto "Epoxy Resins (Epoxy Jushi)" published by Nikkan Kogyo Shinbunsha (1969); melamine resins such as described in Ichiro Miwa and Hideo Matsunaga "Urea and Melamine Resins (Urea-Melamine Jushi)" published by Nikkan Kogyo Shinbunsha (1969); and poly(-meth)acrylate compounds as described in Shin Ogawara, Takeo Saegusa and Toshinobu Higashimura "Oligomers" published by Kodansha (1976) and Eizo Omori "Functional Acrylic Resins" published by Technosystem (1985), for example, polyethylene glycol diacrylate, neopentyl glycol diacrylate, 1,6-hexanediol diacrylate, trimethylolpropane triacrylate, pentaerythritol polyacrylate, bisphenol A-diglycidyl ether diacrylate, oligoester acrylate and methacrylates thereof and the like.

Of the multifunctional monomers or oligomers having two or more polymerizable functional groups, used in the above described polymerization reaction examples of the monomer or oligomer having two or more same polymerizable functional groups are styrene derivatives such as divinyl benzene and trivinyl benzene; esters of polyhydric alcohols such as ethylene glycol, diethylene glycol, triethylene glycol, polyethylene glycols Nos. 200, 400 and 600, 1,3-butylene glycol, neopentyl glycol, dipropylene glyclol, polypropylene glycol, trimethylolpropane, trimethylolethane, pentaerythritol and the like or polyhydroxyphenols such as hydroquinone, resorcinol, catechol and derivatives thereof with methacrylic acid, acrylic acid or crotonic acid, vinyl ethers and allyl ethers; vinyl esters of dibasic acids such as malonic acid, succinic acid, glutaric acid, adipic acid, pimelic acid, maleic acid, phthalic acid, itaconic acid and the like, allyl esters, vinylamides and allylamides; and condensates of polyamines such as ethylenediamine, 1,3-propylenediamine, 1,4-butylenediamine and the like with carboxylic acids containing vinyl groups such as methacrylic acid, acrylic acid, crotonic acid, allylacetic acid and the like.

As the multifunctional monomer or oligomer having two or more different polymerizable functional groups, there can be used, for example, ester derivatives or amide derivatives containing vinyl groups of carboxylic acids containing vinyl group, such as methacrylic acid, acrylic acid, methacryloylacetic acid, acryloylacetic acid, methacryloylpropionic acid, acryloylpropionic acid, itaconyloylacetic acid and itaconyloylpropionic acid, reaction products of carboxylic anhydrides with alcohols or amines such as allyloxycarbonylpropionic acid, allyloxycarbonylacetic acid, 2-allyloxycarbonylbenzoic acid, allylaminocarbonylpropionic acid and the like, for example, vinyl methacrylate, vinyl acrylate, vinyl itaconate, allyl methacrylate, allyl acrylate, allyl itaconate, vinyl methacryloylacetate, vinyl methacryloylpropionate, allyl methacryloylpropionate, vinyloxycarbonylmethyl methacrylate, 2-(vinyloxycarbonyl)ethyl ester of acrylic acid, N-allylacrylamide, N-allylmethacrylamide, N-allylitaconamide, methcaryloylpropionic acid allylamide and the like; and condensates of amino alcohols such as aminoethanol, 1-aminopropanol, 1-aminobutanol, 1-aminohexanol, 2-aminobutanol and the like with carboxylic acids containing vinyl groups.

The monomer or oligomer containing two or more polymerizable functional groups of the present invention is generally used in a proportion of at most 10 wt%, preferably at most 5 wt% to all monomers, which is polymerized to form a resin.

As illustrated above, the resin grains of the present invention contain functional groups capable of forming polar or hydrophilic groups through decomposition, and optionally have such a structure that the interior of the resin is crosslinked.

The resin grains of the present invention preferably have a grain diameter that is not so large, since if it is too large, an oily ink does not uniformly adhere during drawing an image and it is thus difficult to form a clear image area.

Specifically, the resin grains of the present invention have a maximum grain diameter of at most 10 μm, preferably at most 5 μm and an average grain diameter of at most 1.0 μm, preferably at most 0.5 μm. The specific surface areas of the resin grains are increased with the decrease of the grain diameter, resulting in good direct imaging properties, and the grain size of colloidal grains, i.e., about 0.01 μm or smaller is sufficient. However, very small grains cause the similar troubles to those in the case of molecular dispersion and accordingly a grain size of 0.005 μm or larger is preferable.

The resin grains of the present invention, having a fine grain diameter, can be given a desired grain size by jointly dispersing the resin grains when preparing an image receptive layer-forming composition. Alternatively, a method of forming fine grains by dry or wet process or a method of obtaining high molecular gel latexes can be employed as well known in the art.

That is, there are, for example, (a) a method comprising directly pulverizing the resin powder by means of a pulverizing mill or dispersing mill of the prior art, such as ball mill, paint shaker, sound mill, hammer mill, jet mill, kedy mill, etc. and thus obtaining fine grains, and (b) a method of obtaining high molecular latex grains. The latter method of obtaining high molecular latex grains can be carried out according to the prior art method for producing latex grains of paints or liquid developers for electrophotography. That is, this method comprises dispersing the resin by the joint use of a dispersing polymer, more specifically previously mixing the resin and dispersion aid polymer, followed by pulverizing, and then dispersing the pulverized mixture in the presence of the dispersing polymer.

For example, these methods are described in "Flowing and Pigment Dispersion of Paints" translated by Kenji Ueki and published by Kyoritsu Shuppan (1971), Solomon "Chemistry of Paints", "Paint and Surface Coating Theory and Practice", Yuji Harasaki "Coating Engineering (Coating Kogaku)" published by Asakura Shoten (1971), Yuji Harasaki "Fundamental Science of Coating (Kiso Kagaku of Coating)" by Maki Shoten (1977) and Japanese Patent Laid-Open Publication Nos. 96954/1987, 115171/1987 and 75651/1987.

Furthermore, the prior art method of obtaining readily latex grains or particles by suspension polymerization or dispersion polymerization can also be used in the present invention, for example, as described in Soichi Muroi "Chemistry of High Molecular Latex (Kobunshi Latex no Kagaku)" published by Kobunshi Kankokai (1970), Taira Okuda and Hiroshi Inagaki "Synthetic Resin Emulsions (Gosei Jushi Emulsion)" published by Kobunshi Kankokai (1978), Soichi Muroi "Introduction to High Molecular Latexes (Kobunshi Latex Nyumon)" published by Kobunsha (1983).

In the present invention, it is preferable to use a method of obtaining high molecular latex grains, whereby resin grains with an average grain diameter of at most 1.0 μm can readily be obtained.

The latex grains of the present invention can be any latex of aqueous and non-aqueous latexes. As the non-aqueous solvent for the non-aqueous system latex, there can be used any of organic solvents having a boiling point of at most 200° C., individually or in combination. Useful examples of the organic solvent are alcohols such as methanol, ethanol, propanol, butanol, fluorinated alcohols and benzyl alcohol, ketones such as acetone, methyl ethyl ketone, cyclohexanone and diethyl ketone, ethers such as diethyl ether, tetrahydrofuran and dioxane, carboxylic acid esters such as methyl acetate, ethyl acetate, butyl acetate and methyl propionate, aliphatic hydrocarbons containing 6 to 14 carbon atoms such as hexane, octane, decane, dodecane, tridecane, cyclohexane and cyclooctane, aromatic hydrocarbons such as benzene, toluene, xylene and chlorobenzene and halogenated hydrocarbons such as methylene chloride, dichloroethane, tetrachloroethane, chloroform, methylchloroform, dichloropropane and trichloroethane.

When a high molecular latex is synthesized by the dispersion polymerization method in a non-aqueous solvent system, the average grain diameter of the latex grains can readily be adjusted to at most 1 μm while simultaneously obtaining grains of monodisperse system with a very narrow distribution of grain diameters. Such a method is described in, for example, K. E. J. Barrett "Dispersion Polymerization in Organic Media" John Wiley & Sons (1975), Koichiro Murata "Polymer Processings (Kobunshi Kako)" 23, 20 (1974), Tsunetaka Matsumoto and Toyokichi Tange "Journal of Japan Adhesive Association (Nippon Setchaku Kyokaishi)" 9, 183 (1973), Toyokichi Tange "Journal of Japan Adhesive Association".

The resin grains of the present invention can generally be used in a proportion of 0.1 to 80 parts by weight, preferably 1 to 50 parts by weight to 100 parts by weight of a matrix resin of the image receptive layer, since if too small, its effect is largely decreased, while if too large, the etching speed is decreased although the hydrophilic property of a non-image area is improved.

The resin grains of the present invention have the functional groups protecting the polar or hydrophilic groups, i.e., functional groups capable of forming the polar or hydrophilic groups through decomposition, as described above, whereby drawing of an image can favorably be accomplished and on the other hand, the polar groups, i.e., hydrophilic groups are formed by an oil-desensitizing treatment to improve the hydrophilic property of a non-image area.

Since the resin grains of the present invention have a crosslinking structure in a part of the polymer as the more preferred embodiment, furthermore, the resin containing the polar groups formed by an oil-desensitizing treatment, in a precursor, is prevented from being water-soluble and dissolving out of a non-image area, while, maintaining the hydrophilic property. Therefore, the hydrophilic property of the non-image area can further be enhanced by the polar groups formed in the resin and moreover, the durability of this effect can be improved.

In a prior patent application (Japanese Patent Application No. 9159/1987) in which a resin containing functional groups capable of forming carboxyl groups through decomposition, as described above, is jointly used with a predominant component (matrix) in an image receptive layer, the resin is dispersed under molecular state. In the present invention, on the other hand, the resin is dispersed under granular state with a fine grain diameter, so that the polar groups can more readily be formed by an oil-desensitizing treatment and the hydrophilic degree due to the thus formed polar groups can more be increased, as compared with the prior invention. This is probably due to that the specific area is more increased when the resin is dispersed in the form of fine grains with a fine grain size than dispersed under molecular state.

As illustrated above, the resin grains according to the present invention which contains at least one functional group capable of forming a polar group through decomposition is hydrolyzed or hydrogenolyzed upon contact with an oil-desensitizing solution or dampening water used during printing thereby to form the polar group.

In a lithographic printing plate precursor of the present invention, containing the resin grains in an image receptive layer, therefore, the hydrophilic property of a non-image area to be rendered hydrophilic by an oil-desensitizing solution can be enhanced by the thus formed polar group in the resin grains and consequently, a marked contrast can be provided between the lipophilic property of the image area and the hydrophilic property of the non-image area to prevent adhesion of a printing ink onto the non-image area during printing. Thus, provision of a lithographic printing plate precursor capable of producing a large number of prints having a clear image free from background stains has now been realized.

In the case of the above described resin grains, at least a part of which is crosslinked, the water solubility is markedly lowered while maintaining the hydrophilicity, so that it be hardly soluble or insoluble in water. Thus, the hydrophilic property of a non-image area can further be enhanced by the polar groups of the resin and the durability is improved. This results in the specific effects or merits that even if the quantity of the above described functional groups in the resin is decreased, the effect of the improved hydrophilic property can be maintained unchanged and even if printing conditions become severer, for example, a printing machine is large-sized or printing pressure is fluctuated, a large number of prints with a clear image quality and free from background stains can be obtained.

As the matrix resin used in the image receptive layer of the present invention, there can be used all of known resins, typical of which are vinyl chloride-vinyl acetate copolymers, styrene-butadiene copolymers, styrene-methacrylate copolymers, methacrylate copolymers, acrylate copolymers, vinyl acetate copolymers, polyvinyl butyral, alkyd resins, silicone resins, epoxy resins, epoxyester resins, polyester resins and the like, as described in Takaharu Kurita and Jiro Ishiwataru "High Molecular Materials (Kobunshi)" 17, 278 (1968), Harumi Miyamoto and Hidehiko Takei "Imaging" No. 8, page 9 (1973), Koichi Nakamura "Practical Technique of Binders for Recording Materials (Kiroku Zairyoyo Binder no Jissai Gijutsu)" Section 10, published by C. M. C. Shuppan (1985), D. D. Tatt, S. C. Heidecker "Tappi" 49, No. 10, 439 (1966), E. S. Baltazzi, R. G. Blanckette et al. "Photo Sci. Eng." 16, No. 5, 354 (1972), Nguyen Chank Khe, Isamu Shimizu and Eiichi Inoue "Journal of Electrophotographic Association (Denshi Shashin Gakkaishi)" 18, No. 2, 28 (1980), Japanese Patent Publication No. 31011/1975, Japanese Patent Laid-Open Publication Nos. 54027/1978, 20735/1979, 202544/1982 and 68046/1983.

Other examples of the matrix resin are water-soluble polymers such as polyvinyl alcohol, modified polyvinyl alcohol, starch, oxidized starch, carboxymethylcellulose, hydroxyethylcellulose, casein, gelatin, polyacrylates, polyvinylpyrrolidone, vinyl ether-maleic anhydride copolymers, polyamide, polyacrylamide and the like.

The matrix resin used in the present invention has preferably a molecular weight of $10^3$ to $10^6$, more preferably $5\times10^3$ to $5\times10^5$ and a glass transition point of $-10°$ C. to 120° C., more preferably 0° C. to 85° C.

The above described binder resin serves to not only disperse and fix the foregoing resin grains capable of forming the polar group through decomposition in an image receptive layer, but also combine closely the image receptive layer with a base or interlayer.

As other components of the image receptive layer according to the present invention, there can be used inorganic pigments, for example, kaolin clay, calcium carbonate, silica, titanium oxide, zinc oxide, barium sulfate, alumina and the like.

The ratio of a matrix resin/pigment in the image receptive layer, depending on the kinds of materials and the grain size of the pigment, is generally in the range of 1/(0.5 to 5), preferably 1/(0.8 to 2.5).

In addition, a crosslinking agent can be added to the image receptive layer of the present invention so as to further increase the film strength. Examples of the crosslinking agent are ammonium chloride, organic peroxides, metallic soap, organic silane, crosslinking agents of polyurethanes and hardening agents of epoxy resins, commonly used in the art, as described in Shinzo Yamashita and Tosuke Kaneko "Crosslinking Agents Handbook (Kakyozai Handbook)" published by Taiseisha (1981).

As the base used in the present invention, there are given fine quality paper, moistened and strengthened paper, plastic films such as polyester films and metal sheets such as aluminum sheets.

In the present invention, furthermore, there can be provided an intermediate layer or interlayer between the base and image receptive layer for the purpose of improving the waterproofness and adhesiveness therebetween and a back coated layer (back layer) on the opposite surface of the base to the image receptive layer to prevent from curling.

The intermediate layer is generally composed of, as a predominant component, at least one member of emulsion type resins such as acrylic resins, styrene-butadiene copolymers, methacrylic acid ester-butadiene copolymers, acrylonitrile-butadiene copolymers and ethylene-vinyl acetate copolymers; solvent type resins such as epoxy resins, polyvinyl butyral, polyvinyl chloride and polyvinyl acetate; and water-soluble resins as described above. If necessary, inorganic pigments and waterproofing agents can be added.

The back coated layer is generally composed of similar materials to those of the intermediate layer.

When using the printing plate precursor of the present invention for PPC, in order to reduce further background stains, dielectrics or electric conducts can be added to the image receptive layer, intermediate layer and/or back coated layer of the present invention in such a manner that the volume specific resistivity, as a printing plate precursor, becomes $10^{10}$ to $10^{13}$ $\omega$Cm. The electric conduct includes inorganic materials, for example, salts of monovalent or polyvalent metals such as Na, K, Li, Mg, Zn, Co and Ni and organic materials, for example, cationic polymers such as polyvinyl benzyltrimethylammonium chloride and acrylic resin modified quaternary ammonium salt and anionic polymers such as polymeric sulfonates. The amount of the electric conduct imparting agent to be added is generally 3 to 40% by weight, preferably 5 to 20% by weight based on the weight of a binder used in each layer.

Production of the lithographic printing plate precursor of direct imaging type according to the present invention is generally carried out by optionally coating one side of a base with a liquid composition comprising components for the intermediate layer, followed by drying, to form an intermediate layer, then coating with a liquid composition comprising components for the image receptive layer, followed by drying, to form an image receptive layer and optionally coating the other side of the base with a liquid composition comprising components for the back coated layer, followed by drying, to form a back coated layer. The adhesion quantities of the image receptive layer, intermediate layer and back coated layer are respectively 1 to 30 g/m$^2$, 5 to 20 g/m$^2$ and 5 to 20 g/m$^2$.

The present invention will now be illustrated in greater detail by way of examples, but it should be understood that the present invention is not limited thereto.

EXAMPLES

Preparation Example 1 of Resin Grains

A mixed solution of 95 g of dodecyl methacrylate, 5 g of acrylic acid and 200 g of toluene was heated to 70° C. while stirring under a nitrogen stream, and 1.5 g of azobis(isobutyronitrile) (referred to as A.I.B.N.) was added thereto and reacted for 8 hours. To this reaction mixture were added 12 g of glycidyl methacrylate, 1 g of t-butylhydroquinone and 0.8 g of N,N-dimethyldodecylamine, followed by allowing the mixture to react at 100° C. for 15 hours (Dispersed Resin I).

A mixture of 8.0 g (as solid content) of the above described Dispersed Resin I, 10 g of methyl methacrylate, 1.0 g of diethylene glycol dimethacrylate, 40 g of the following monomer (M-1) and 250 g of n-heptane was heated to 60° C. while stirring under a nitrogen stream, and 0.3 g of 2,2-azobis(isovaleronitrile) (referred to as A.I.V.N.) was then added thereto and reacted for 6 hours.

After passage of 20 minutes from the addition of the initiator (A.I.V.N.), the homogeneous solution became slightly opaque, the reaction temperature being raised to 90° C. After cooling, the reaction product was passed through a nylon cloth of 200 mesh to obtain a white dispersion having an average grain diameter of 0.25 μm as a white latex.

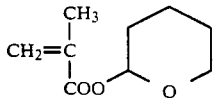

Monomer M-1

Preparation Examples 2 to 11 of Resin Grains

The procedure of Preparation Example 1 was repeated except using the following monomers shown in Table 2 instead of the monomer M-1 of Preparation Example 1, thus preparing resin grains.

TABLE 2

| Preparation Example | Monomer | Grain Diameter of Resin Grains (μm) |
|---|---|---|
| 2 | 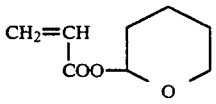 M-2 | 0.3 |
| 3 | 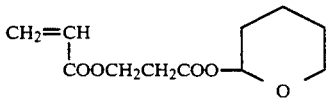 M-3 | 0.25 |

TABLE 2-continued

| Preparation Example | Monomer | Grain Diameter of Resin Grains (μm) |
|---|---|---|
| 4 | 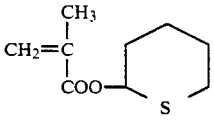 M-4 | 0.25 |
| 5 | 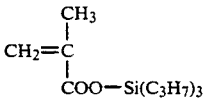 M-5 | 0.26 |
| 6 | 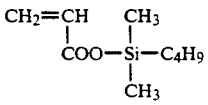 M-6 | 0.25 |
| 7 | 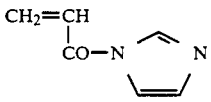 M-7 | 0.3 |
| 8 | 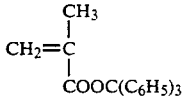 M-8 | 0.24 |
| 9 | 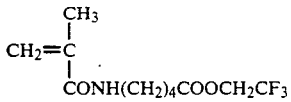 M-9 | 0.28 |
| 10 | 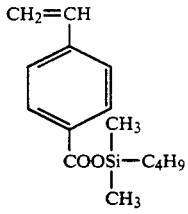 M-10 | 0.20 |
| 11 | 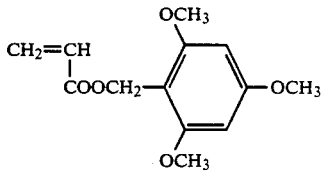 M-11 | 0.20 |

Preparation Example 12 of Resin Grains

A mixture of 31.5 g of ethylene glycol, 51.8 g of phthalic anhydride, 6.0 g of methacrylic acid, 10 g of trichloroethylene and 0.7 g of p-toluenesulfonic acid was heated and reacted for 6 hours in such a manner that the reaction temperature was raised from 107° C. to 150° C. in 6 hours, while removing water byproduced by the reaction by the Dean-Stark method, thus obtaining Dispersed Resin II.

A mixture of 3 g (as solid) of Dispersed Resin II, 30 g of the following monomer (M-12), 0.03 g of 1,6-hexanediol diacrylate and 150 g of ethyl acetate was heated at 60° C. under a nitrogen stream, to which 0.05 g of A.I.V.N. was added, followed by subjecting the mixture to reaction for 4 hours to obtain a white dispersion.

After cooling, the reaction product was passed through a nylon cloth to obtain a dispersion with an average grain diameter of 0.3 μm.

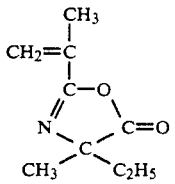

Monomer M-12

Preparation Example 13 of Resin Grains

A mixed solution of 7.5 g of Dispersed Resin I, 40 g of the following monomer M-13, 10 g of styrene, 1.0 g of divinylbenzene and 300 g of n-octane was heated at 50° C. under a nitrogen stream, to which 0.5 g (as solid) of n-butyllithium was added, followed by subjecting the mixture to reaction for 6 hours, thus obtaining a white dispersion with an average grain diameter of 0.17 μm.

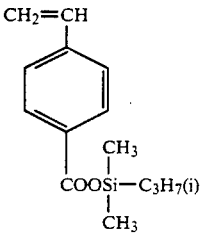

Monomer M-13

Preparation Example 14 of Resin Grains

A mixture of 20 g of Monomer M-I, 0.5 g of diethylene glycol dimethacrylate and 100 g of tetrahydrofuran was heated at 75° C. under a nitrogen stream, to which 0.2 g A.I.B.N. was added, followed by subjecting the mixture for 6 hours.

After cooling, the reaction product was subjected to reprecipitation in 500 ml of methanol to collect a white dispersion and dried. The yield was 16 g.

Example 1

A mixture of 40 g of ethyl methacrylate, 40 g of 2,2,2-trichloroethyl methacrylate, 20 g of 2-hydroxyethyl methacrylate and 200 g of toluene was heated at 75° C. under a nitrogen stream, to which 1.5 g of A.I.B.N. was added, followed by reacting the mixture for 8 hours, thus obtaining a copolymer with a weight average molecular weight of 41000.

Using a fine quality paper coated with, on one side thereof, a back layer and on the other side thereof, an intermediate layer, onto the intermediate layer was coated a dispersion obtained by ball milling for 2 hours a mixture of 40 g of the above described copolymer, 40 g (as solid content) of the resin grains of Preparation Example 1, 100 g of zinc oxide, 3 g of 1,6-hexamethylene diisocyanate and 300 g of toluene to give a dry coverage of 18 g $m^2$ by means of a wire bar coater, followed by drying at 100° C. for 2 hours, to prepare a lithographic printing plate precursor.

The resulting precursor was passed once through an etching processor using an oil-desensitizing solution ELP-EX (-commercial name- manufactured by Fuji Photo Film Co., Ltd.). On the thus oil-desensitized surface was placed a drop of 2 μl of distilled water and the contact angle between the surface and water was measured by a goniometer to obtain a contact angle with water of 10°. Before the oil-desensitizing processing, it was 98°. This tells that a non-image area on the image receptive layer in the precursor of the present invention was changed from lipophilic to hydrophilic. Ordinarily, it is required that such a degree of rendering hydrophilic that a non-image area does not produce background stains or spot-like stains during printing corresponds to a contact angle with water of 20° or less.

The precursor was subjected to plate making by means of a commercially available PPC and then to an oil-desensitizing processing under the similar conditions to those described above to obtain a printing master plate. The resulting master plate had an image area with a density of at least 1.0 and clear image quality and a non-image area free from background stains, and was subjected to printing on fine quality papers using an offset printing machine (Hamada Star 800 SK -commercial name-, manufactured by Hamada Star KK). More than 3000 prints could be obtained without any problem on the background stains of non-image areas and the image quality of image areas.

Furthermore, when the above described precursor was subjected to plate making by a commercially available plain paper copy machine (PPC) under ambient conditions of 30° C. and 80% RH, the resulting master plate had an image area with a density of at least 1.0 and clear image quality and a non-image area free from background stains. When it was subjected to printing in the same manner as described above, there arose no problem even after printing 3000 prints or more.

As apparent from these results, the precursor of the present invention does not meet with deterioration of image quality in plate making of PPC even under high temperature and high humidity conditions.

Examples 2 to 9

The procedure of Example 1 was repeated except using each of resin grains shown in Table 3 instead of the resin grains of Example 1 to prepare a lithographic printing plate precursor.

TABLE 3

| Example | Resin Grains |
|---|---|
| 2 | Preparation Example of Resin Grains 2 |
| 3 | 3 |
| 4 | 4 |
| 5 | 5 |
| 6 | 6 |
| 7 | 7 |
| 8 | 8 |
| 9 | 9 |

When these printing plate precursor were then subjected to evaluation of the contact angle with water. image quality after PPC plate making and printing results as in Example 1, more than 3000 prints were obtained with a clear image quality and without occurrenge of background stains on non-image areas.

Example 10

As the resin grains of the present invention, there was used a dispersion obtained by dispersing for 1 hour in a ball mill a mixture of 150 g of a 15% aqueous emulsion of poly(N-(11-tetrahydropyranyloxycarbonyl-decamethylene)methacrylamide), 300 g of a 20% aqueous emulsion of n-butyl ethacrylate/4-cyanophenyl methacrylate (6/4 by weight) copolymer with a weight average molecular weight of 35,000, 200 g of a 10% aqueous solution of polyvinyl alcohol (PVA-117 -commercial name-, manufactured by Kurare KK), 8 g of a 80% aqueous solution of melamine formaldehyde resin and 400 g of a 20% mixed dispersion of zinc oxide/silica (2/8 by weight). This dispersion was coated onto the intermediate layer on the base, same as that of Example 1, to give a dry coverage of 8 g/m$^2$ by a wire bar coater and dried at 120° C. for 1.5 hours to prepare a lithographic printing plate precursor.

When the resulting precursor was then subjected to the processings and printing in an analogous manner to Example 1, more than 3000 prints were obtained with a clear image area and background stain-free non-image area.

Preparation Example 15 of Resin Grains

A mixed solution of 95 g of dodecyl methacrylate, 5 g of acrylic acid and 200 g of toluene was heated to 70° C. while stirring under a nitrogen stream, and 1.5 g of azobis(isobutyronitrile) (referred to as A.I.B. N.) was added thereto and reacted for 8 hours. To this reaction mixture were added 12 g of glycidyl methacrylate, 1 g of t-butylhydroquinone and 0.8 g of N,N-di-methyl-dodecylamine, followed by allowing the mixture to react at 100° C. for 15 hours (Dispersed Resin III).

A mixture of 8.5 g (as solid content) of Dispersed Resin III, 40 g of the monomer (M-14), 10 g of 2-cyanoethyl methacrylate and 250 g of n-heptane was heated to 60° C. while stirring under a nitrogen stream, to which 0.3 g of 2,2'-azobis(isovaleronitrile)(referred to as A.I.V.N.) was then added, followed by reaction for 6 hours.

After passage of 20 minutes from the addition of the initiator (A.I.V.N.), the homogeneous solution became slightly opaque, the reaction temperature being raised to 90° C. After cooling, the reaction product was passed through a nylon cloth of 200 mesh to obtain a white dispersion, as a latex with an average grain diameter of 0.25 μm.

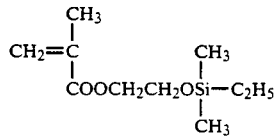

Monomer 14

Preparation Examples 16 to 27 of Resin Grains

The procedure of Preparation Example 15 was repeated except using monomers shown in Table 4 instead of Monomer M-14 obtained in Preparation Example 15.

TABLE 4

| Preparation Examples | | Monomer | Average Grain Diameter (μm) |
|---|---|---|---|
| 16 | M-15 | 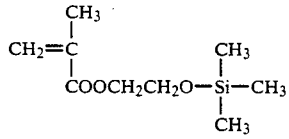 | 0.35 |
| 17 | M-16 | 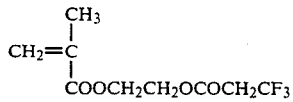 | 0.40 |
| 18 | M-17 | 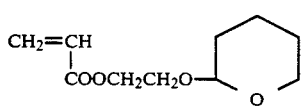 | 0.45 |
| 19 | M-18 | 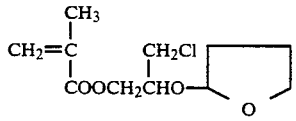 | 0.38 |
| 20 | M-19 | 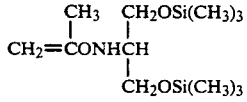 | 0.35 |
| 21 | M-20 | 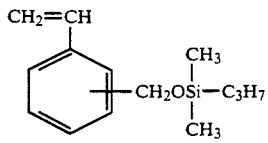 | 0.28 |

TABLE 4-continued

| Preparation Examples | Monomer | Average Grain Diameter (μm) |
|---|---|---|
| 22 | M-21 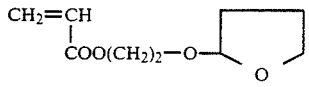 | 0.34 |
| 23 | M-22 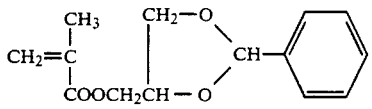 | 0.25 |
| 24 | M-23 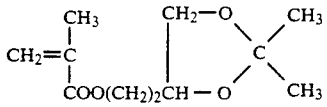 | 0.23 |
| 25 | M-24 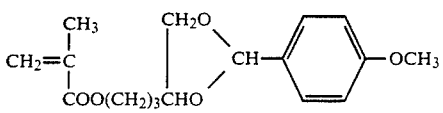 | 0.21 |
| 26 | M-25 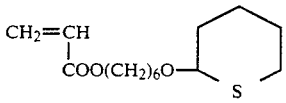 | 0.30 |
| 27 | M-26 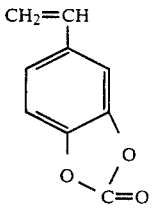 | 0.29 |

Preparation Example 28 of Resin Grains

A mixed solution of 95 g of dodecyl methacrylate, 50 g of isopropyl alcohol and 150 g of toluene was heated to 70° C. while stirring under a nitrogen stream, to which 5 g of 2,2'-azobis(4-cyanovaleric acid) (referred to as A.C.V.) was added, followed by reacting the mixture for 8 hours. This mixed solution was subjected to a reprecipitation treatment in 1.5 l of methanol and the precipitate (resin) was dried under reduced pressure at 40° C.

A mixture of 80 g of this resin, 10 g of glycidyl methacrylate, 0.7 g of N,N-dimethyldodecylamine, 1 g of t-butylhydroquinone and 200 g of toluene was heated at 95° C. to form a homogeneous solution and stirred for 48 hours as it was. The reaction product was then subjected to a reprecipitation treatment in 1.2 l of methanol and the precipitate was dried at 30° C. under reduced pressure to obtain Dispersed Resin IV.

A mixture of 10 g of Dispersed Resin IV, 50 g of the following monomer M-27, 0.4 g of divinylbenzene and 280 g of n-octane was heated at 60° C. under a nitrogen stream to form a homogeneous solution, to which 0.04 g of A. I. V. N. was then added, followed by reacting the mixture for 5 hours to obtain a white dispersion. After cooling, the reaction product was passed through a nylon cloth of 200 mesh, thus obtaining a dispersion with an average grain diameter of 0.25 μm.

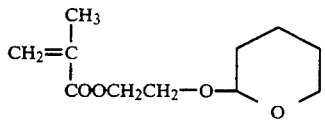

Monomer-27

Preparation Examples 29 to 37 of Resin Grains

The procedure of Preparation Example 28 was repeated except using monomers and crosslinking monomers shown in Table 5 instead of Monomer M-27 and the divinylbenzene used in Preparation Example 28, thus obtaining resin grains.

TABLE 5

| Preparation Examples | Monomer: | Crosslinking Monomer | Amount of Crosslinking Monomer (g) | Average Grain Diameter (μm) |
|---|---|---|---|---|
| 29 | M-15 | ethylene glycol dimethacrylate | 0.5 | 0.28 |

TABLE 5-continued

| Preparation Examples | | Monomer: | Crosslinking Monomer | Amount of Crosslinking Monomer (g) | Average Grain Diameter (μm) |
|---|---|---|---|---|---|
| 30 | M-28 | $CH_2=C(CH_3)COO(CH_2)_2OCOCH(CF_3)_2$ | diethylene glycol dimethacrylate | 0.6 | 0.30 |
| 31 | M-29 | 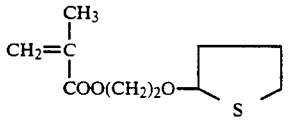 | trimethylolpropane triacrylate | 0.6 | 0.32 |
| 32 | M-30 | 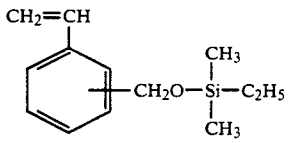 | divinylbenzene | 0.3 | 0.20 |
| 33 | M-21 | | ethylene glycol diacrylate | 0.3 | 0.25 |
| 34 | M-31 | 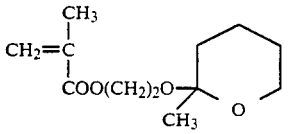 | IPS-22GA* | 0.5 | 0.22 |
| 35 | M-22 | | polyethylene glycol No. 400 dimethacrylate** | 0.6 | 0.18 |
| 36 | M-32 | $CH_2=C(CH_3)COOCH_2CH(CH_3)CH_2Si(CH_3)_3$ | vinyl methacrylate | 0.8 | 0.20 |
| 37 | M-24 | | allyl methacrylate | 1.0 | 0.15 |

Note:
*commercial name, made by Okamura Seiyu KK
**commercial name, made by Shin-Nakamura Kagaku KK Preparation Example 38 of Resin Grains A mixture of 7.5 g of Dispersed Resin IV, 45 g of the following monomer M-33, 5 g of styrene, 1.0 g of divinylbenzene and 300 g of n-octane was heated to 50° C. under a nitrogen stream, to which 0.5 g (as solid content) of n-butyllithium was added, followed by reacting the mixture for 6 hours to obtain a white dispersion with an average grain diameter of 0.15 μm.

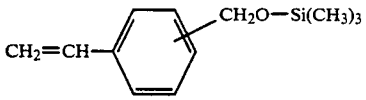

Monomer M-33

Preparation Example 39 of Resin Grains

A mixed solution of 20 g of Monomer M-14, 0.5 g of diethylene glycol dimethacrylate and 100 g of tetrahydrofuran was heated to 75° C. under a nitrogen stream, to which 0.2 g of A.I.B.N. was added, followed by subjecting the mixture to reaction for 6 hours.

After cooling, the reaction product was subjected to a reprecipitation treatment in 500 ml of methanol to obtain a white product, which was then collected by filtering and dried. The yield was 15 g.

Example 11

A mixture of 40 g of butyl methacrylate, 30 g of 2-hydroxyethyl methacrylate, 20 g of 4-cyanophenyl acrylate and 200 g of toluene was heated at 75° C. under a nitrogen stream, to which 1.5 g of A.I.B.N. was added, followed by reacting the mixture for 8 hours, thus obtaining a copolymer with a weight average molecular weight of 41000.

Using a fine quality paper coated with, on one side thereof, a back layer and on the other side thereof, an intermediate layer, onto the intermediate layer was coated a dispersion obtained by ball milling for 2 hours a mixture of 40 g of the above described copolymer, 10 g (as solid content) of the resin grains of Preparation Example 15, 100 of zinc oxide and 300 g of toluene and further adding 3 g of 1,4-tetramethylene diisocyanate thereto, followed by dispersing for 10 minutes to give a dry coverage of 18 g/m$^2$ by means of a wire bar coater, followed by drying at 100° C. for 2 hours, to prepare a lithographic printing plate precursor.

The resulting precursor was passed once through an etching processor using an oil-desensitizing solution ELP-EX (-commercial name- manufactured by Fuji Photo Film Co., Ltd.). On the thus oil-desensitized surface was placed a drop of 2 μl of distilled water and the contact angle between the surface and water was measured by a goniometer to obtain a contact angle with water of 10°. Before the oil-desensitizing processing, it was 100°. This tells that a non-image area on the image receptive layer in the precursor of the present invention was changed from lipophilic to hydrophilic. Ordinarily, it is required that such a degree of rendering hydrophilic that a non-image area does not produce background stains or spot-like stains during printing corresponds to a contact angle with water of 20° or less.

The precursor was subjected to plate making by means of a commercially available PPC and then to an oil-desensitizing processing under the similar conditions to those described above to obtain a printing master plate. The resulting master plate had an image area with a density of at least 1.0 and clear image quality and a non-image area free from background stains, and was subjected to printing on fine quality papers using an offset printing machine (Hamada Star 800 SK -commercial name-, manufactured by Hamada Star KK). More than 3000 prints could be obtained without any problem on the background stains of non-image areas and the image quality of image areas.

Furthermore, when the above described precursor was subjected to plate making by a commercially available PPC under ambient conditions of 30° C. and 80% RH, the resulting master plate had an image area with a density of at least 1.0 and clear image quality and a non-image area free from background stains. When it was subjected to printing in the same manner as described above, there arose no problem even after printing 3000 prints or more.

As apparent from these results, the precursor of the present invention does not meet with deterioration of image quality in plate making of PPC even under high temperature and high humidity conditions.

Examples 12 to 25

The procedure of Example 11 was repeated except using each of resin grains shown in Table 6 instead of the resin grains of Example 11 to prepare a lithographic printing plate precursor.

TABLE 6

| Example | Resin Grains |
|---|---|
| 12 | Preparation Example 16 |
| 13 | 17 |
| 14 | 18 |
| 15 | 20 |
| 16 | 23 |
| 17 | 25 |
| 18 | 26 |
| 19 | 28 |
| 20 | 29 |
| 21 | 31 |
| 22 | 32 |
| 23 | 34 |
| 24 | 35 |
| 25 | 38 |

When these printing plate precursor were then subjected to evaluation of the contact angle with water, image quality after PPC plate making and printing results as in Example 11, more than 3000 prints were obtained with a clear image quality and without occurrence of background stains on non-image areas.

EXAMPLE 26

As the resin grains of the present invention, there was used a dispersion obtained by dispersing for 1 hour in a ball mill a mixture of 150 g of a 15% aqueous emulsion of poly(2-trimethylsilyloxoethyl methacrylate), 300 g of a 20% aqueous emulsion of n-butyl methacrylate/4-cyanophenyl methacrylate (6/4 by weight) copolymer with a weight average molecular weight of 35,000, 200 g of a 10% aqueous solution of polyvinyl alcohol (PVA-117-commercial name-, manufactured by Kurare KK), 8 g of a 80% aqueous solution of melamine formaldehyde resin and 400 g of a 20% mixed dispersion of zinc oxide/silica (2/8 by weight). This dispersion was coated onto the intermediate layer on the base, same as that of Example 11, to give a dry coverage of 8 g/m$^2$ by a wire bar coater and dried at 120° C. for 2 hours to prepare a lithographic printing plate precursor.

When the resulting precursor was then subjected to the processings and printing in an analogous manner to Example 11, more than 3000 prints were obtained with a clear image area and background stain-free non-image area.

Preparation Example 40 of Resin Grains

A mixed solution of 95 g of dodecyl methacrylate, 5 g of acrylic acid and 200 g of toluene was heated to 70° C. while stirring under a nitrogen stream, and 1.5 g of azobis(isobutyronitrile) (referred to as A.I.B.N.) was added thereto and reacted for 8 hours. To this reaction mixture were added 12 g of glycidyl methacrylate, 1 g of t-butylhydroquinone and 0.8 g of N,N-dimethyldodecylamine, followed by allowing the mixture to react at 100° C. for 15 hours (Dispersed Resin V).

A mixture of 9 g (as solid content) of Dispersed Resin V, 40 g of the following monomer (M-34), 10 g of styrene and 250 g of n-octane was then heated to 60° C. while stirring under a nitrogen stream, to which 0.3 g of 2,2'-azobis(isovaleronitrile) referred to as A.I.V. N.) was then added, followed by reaction for 6 hours.

After passage of 20 minutes from the addition of the initiator (A.I.V.N.), the homogeneous solution became slightly opaque, the reaction temperature being raised to 90° C. After cooling, the reaction product was passed through a nylon cloth of 200 mesh to obtain a white dispersion, as a latex with an average grain diameter of 0.25 μm.

Monomer M-34

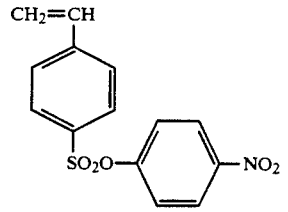

Preparation Examples 41 to 52

The procedure of Preparation Example 40 was repeated except using monomers shown in the following Table 7 instead of Monomer M-34 and 2-cyanoethyl methacrylate instead of the styrene to obtain resin grains.

TABLE 7
| Preparation Examples | | Monomer | Average Grain Diameter (μm) |
|---|---|---|---|
| 41 | M-35 | 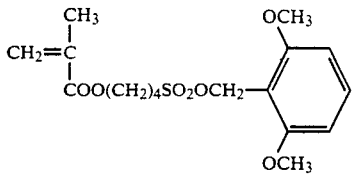 | 0.35 |
| 42 | M-36 | 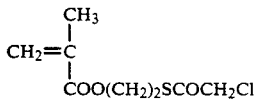 | 0.33 |
| 43 | M-37 | 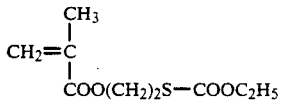 | 0.30 |
| 44 | M-38 | 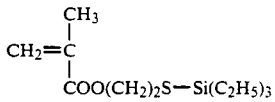 | 0.29 |
| 45 | M-39 | 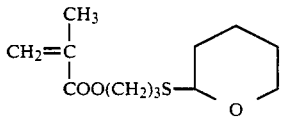 | 0.30 |
| 46 | M-40 | 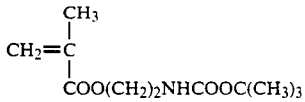 | 0.29 |
| 47 | M-41 | 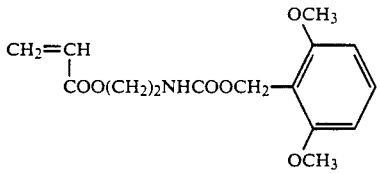 | 0.28 |
| 48 | M-42 | 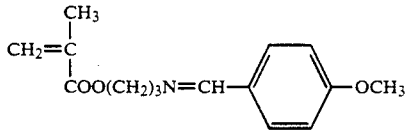 | 0.30 |
| 49 | M-43 | 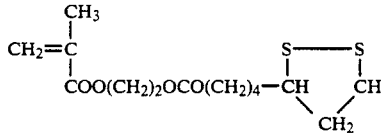 | 0.32 |
| 50 | M-44 | 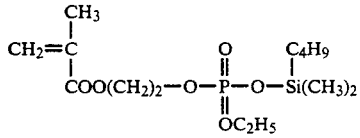 | 0.40 |
| 51 | M-45 | 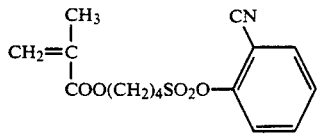 | 0.35 |

TABLE 7-continued

| Preparation Examples | Monomer | Average Grain Diameter (μm) |
|---|---|---|
| 52 | M-46 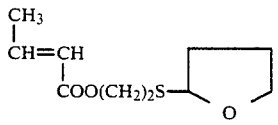 | 0.45 |

Preparation Example 53 of Resin Grains

A mixed solution of 95 g of dodecyl methacrylate, 50 g of isopropyl alcohol and 150 g of toluene was heated to 70° C. while stirring under a nitrogen stream, to which 5 g of 2,2,-azobis(4-cyanovaleric acid) (referred to as A.C.V.) was added, followed by reacting the mixture for 8 hours. This mixed solution was subjected to a reprecipitation treatment in 1.5 l of methanol and the precipitate (resin) was dried under reduced pressure at 40° C.

A mixture of 80 g of this resin, 10 g of glycidyl methacrylate, 0.7 g of N,N-dimethyldodecylamine, 1 g of t-butylhydroquinone and 200 g of toluene was heated at 95° C. to form a homogeneous solution and stirred for 48 hours as it was. The reaction product was then subjected to a reprecipitation treatment in 1.2 l of methanol and the precipitate was dried at 30° C. under reduced pressure to obtain Dispersed Resin VI.

A mixture of 10 g of Dispersed Resin VI, 50 g of the monomer M-34, 0.4 g of divinylbenzene and 280 g of n-octane was heated at 60° C. under a nitrogen stream to form a homogeneous solution, to which 0.04 g of A.I.V.N. was then added, followed by reacting the mixture for 5 hours to obtain a white dispersion. After cooling, the reaction product was passed through a nylon cloth of 200 mesh, thus obtaining a dispersion with an average grain diameter of 0.25 μm.

Preparation Examples 54 to 65 of Resin Grains

The procedure of Preparation Example 53 was repeated except using monomers and crosslinking monomers shown in Table 8 instead of Monomer M-34 and the divinylbenzene used in Preparation Example 53, thus obtaining resin grains.

TABLE 8

| Preparation Example | Monomer | Crosslinking Monomer | Amount of Crosslinking Monomer (g) | Average Grain Diameter (μm) |
|---|---|---|---|---|
| 54 | M-35 | ethylene glycol dimethacrylate | 0.5 | 0.28 |
| 55 | M-36 | diethylene glycol dimethacrylate | 0.6 | 0.25 |
| 56 | M-37 | triethylene glycol diacrylate | 0.6 | 0.26 |
| 57 | M-38 | IPS-22GA* | 0.9 | 0.24 |
| 58 | M-47 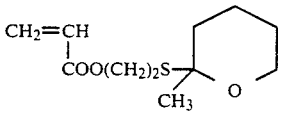 | ethylene glycol diacrylate | 0.5 | 0.25 |
| 59 | M-40 | polyethylene glyclol No. 400 diacrylate** | 1.0 | 0.29 |
| 60 | M-48 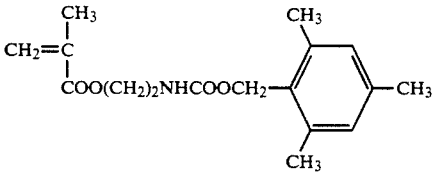 | vinyl methacrylate | 1.2 | 0.20 |
| 61 | M-42 | allyl methacrylate | 1.5 | 0.24 |
| 62 | M-43 | 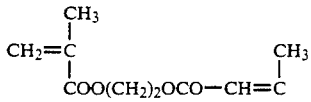 | 0.8 | 0.25 |
| 63 | M-44 | diethylene glycol dimethacryalte | 0.7 | 0.35 |

TABLE 8-continued

| Preparation Example | Monomer | Crosslinking Monomer | Amount of Crosslinking Monomer (g) | Average Grain Diameter (μm) |
|---|---|---|---|---|
| 64 | M-49 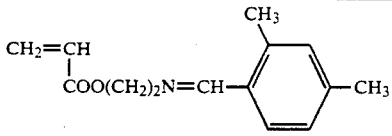 | ethylene glycol diacrylate | 0.5 | 0.21 |
| 65 | M-45 | vinyl adipate | 1.5 | 0.24 |

Note:
* and **See Table 5.

Preparation Example 66 of Resin Grains

A mixture of 8.0 g of Dispersed Resin VI, 45 g of the following monomer M-50, 5 g of styrene, 1.0 g of divinylbenzene and 300 g of n-octane was heated to 50° C. under a nitrogen stream, to which 0.5 g (as solid content) of n-butyllithium was added, followed by reacting the mixture for 6 hours to obtain a white dispersion with an average grain diameter of 0.25 μm.

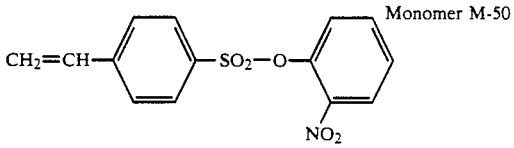

Preparation Example 67 of Resin Grains

A mixed solution of 20 g of Monomer M-34, 0.5 g of diethylene glycol dimethacrylate and 100 g of tetrahydrofuran was heated to 75° C. under a nitrogen stream, to which 0.2 g of A.I.B.N. was added, followed by subjecting the mixture to reaction for 6 hours.

After cooling, the reaction product was subjected to a reprecipitation treatment in 500 ml of methanol to obtain a white product, which was then collected by filtering and dried. The yield was 15 g.

Example 27

A mixture of 40 g of butyl methacrylate, 20 g of 3-hydroxypropyl methacrylate, 20 g of 4-cyanophenyl acrylate and 200 g of toluene was heated at 75° C. under a nitrogen stream, to which 1.5 g of A.I.B.N. was added, followed by reacting the mixture for 8 hours, thus obtaining a copolymer with a weight average molecular weight of 42000.

Using a fine quality paper coated with, on one side thereof, a back layer and on the other side thereof, an intermediate layer, onto the intermediate layer was coated a dispersion obtained by ball milling for 2 hours a mixture of 40 g of the above described copolymer, 10 g (as solid content) of the resin grains of Preparation Example 40, 100 of zinc oxide and 300 g of toluene and further adding 5 g of 1,6-hexane diisocyanate thereto, followed by dispersing for 10 minutes, to give a dry coverage of 18 g/m$^2$ by means of a wire bar coater, followed by drying at 100° C. for 2 hours, to prepare a lithographic printing plate precursor.

The resulting precursor was passed once through an etching processor using an oil-desensitizing solution ELP-EX (-commercial name- manufactured by Fuji Photo Film Co., Ltd.). On the thus oil-desensitized surface was placed a drop of 2 μl of distilled water and the contact angle between the surface and water was measured by a goniometer to obtain a contact angle with water of 10°. Before the oil-desensitizing processing, it was 98°. This tells that a non-image area on the image receptive layer in the precursor of the present invention was changed from lipophilic to hydrophilic. Ordinarily, it is required that such a degree of rendering hydrophilic that a non-image area does not produce background stains or spot-like stains during printing corresponds to a contact angle with water of 20° or less.

The precursor was subjected to plate making by means of a commercially available PPC and then to an oil-desensitizing processing under the similar conditions to those described above to obtain a printing master plate. The resulting master plate had an image area with a density of at least 1.0 and clear image quality and a non-image area free from background stains, and was subjected to printing on fine quality papers using an offset printing machine (Hamada Star 800 SK -commercial name-, manufactured by Hamada Star KK). More than 3000 prints could be obtained without any problem on the background stains of non-image areas and the image quality of image areas.

Furthermore, when the above described precursor was subjected to plate making by a commercially available PPC under ambient conditions of 30° C. and 80% RH, the resulting master plate had an image area with a density of at least 1.0 and clear image quality and a non-image area free from background stains. When it was subjected to printing in the same manner as described above, there arose no problem even after printing 3000 prints or more.

As apparent from these results, the precursor of the present invention does not meet with deterioration of image quality in plate making of PPC even under high temperature and high humidity conditions.

Examples 28 to 47

The procedure of Example 27 was repeated except using each of resin grains shown in Table 9 instead of the resin grains of Example 27 to prepare a lithographic printing plate precursor.

TABLE 9

| Example | Resin Grains |
|---|---|
| 28 | Preparation Example 41 |
| 29 | 42 |
| 30 | 45 |
| 31 | 46 |
| 32 | 47 |
| 33 | 48 |
| 34 | 50 |

TABLE 9-continued

| Example | Resin Grains |
|---|---|
| 35 | 51 |
| 36 | 52 |
| 37 | 53 |
| 38 | 54 |
| 39 | 55 |
| 40 | 56 |
| 41 | 57 |
| 42 | 58 |
| 43 | 60 |
| 44 | 62 |
| 45 | 63 |
| 46 | 64 |
| 47 | 66 |

When these printing plate precursor were then subjected to evaluation of the contact angle with water, image quality after PPC plate making and printing results as in Example 27, more than 3000 prints were obtained with a clear image quality and without occurrence of background stains on non-image areas.

Example 48

As the resin grains of the present invention, there was used a dispersion obtained by dispersing for 1 hour in a ball mill a mixture of 150 g of a 15% aqueous emulsion of a homopolymer of the foregoing monomer M-40, 400 g of a 20% aqueous emulsion of n-butyl methacrylate/4-cyanophenyl methacrylate (6/4 by weight) copolymer (weight average molecular weight of 35,000), 100 g of a 10% aqueous solution of polyvinyl alcohol (PVA-117-commercial name-, manufactured by Kurare KK), 8 g of a 80% aqueous solution of melamine formaldehyde resin and 400 g of a 20% mixed dispersion of zinc oxide/silica (2/8 by weight). This dispersion was coated onto the intermediate layer on the base, same as that of Example 27, to give a dry coverage of 8 g/m$^2$ by a wire bar coater and dried at 120° C. for 2 hours to prepare a lithographic printing plate precursor.

When the resulting precursor was then subjected to the processings and printing in an analogous manner to Example 27, more than 3000 prints were obtained with a clear image area and background stain-free non-image area.

What is claimed is:

1. A lithographic printing plate of direct image type, comprising a base and an image receptive layer provided on the base, in which the image receptive layer contains resin grains containing at least one functional group capable of producing at least one polar group through decomposition by an oil-desensitizing solution or dampening water, wherein the image-receptive layer further contains a matrix resin, wherein said polar group is a hydrophilic group selected from the group consisting of carboxyl, hydroxyl, thiol, phosphono, amino and sulfo groups, and wherein said resin grains are in a proportion of 0.1 to 80 parts by weight to 100 parts by weight of a matrix resin in said image receptive layer.

2. The lithographic printing plate of direct image type as claimed in claim 1, wherein the base consists of a member selected from the group consisting of fine quality papers, moistened and strengthened papers, plastic films and metallic sheets.

3. The lithographic printing plate of direct image type as claimed in claim 1, wherein the image receptive layer further contains at least one inorganic pigment selected from the group consisting of kaolin clay, calcium carbonate, silica, titanium oxide, zinc oxide, barium sulfate and alumina.

4. The lithographic printing plate of direct image type as claimed in claim 3, wherein the inorganic pigment is contained to give a ratio of matrix resin/pigment by weight in the range of 1/(0.3 to 5).

5. The lithographic printing plate of direct image type as claimed in claim 1, wherein the image receptive layer further contains a crosslinking agent.

6. The lithographic printing plate of direct image type as claimed in claim 1, wherein the base is coated with an intermediate layer under the image receptive layer.

7. The lithographic printing plate of direct image type as claimed in claim 1, wherein the base is coated with a back layer on the opposite side to the image receptive layer.

8. The lithographic printing plate of direct image type as claimed in claim 1, wherein at least a part of the functional group-containing resin is crosslinked.

9. The lithographic printing plate of direct image type as claimed in claim 1, wherein the resin grains have a maximum grain diameter of at most 10 μm and an average grain diameter of at most 1 μm.

10. The lithographic printing plate of direct image type as claimed in claim 1, wherein the functional group-containing resin has a molecular weight of $10^3$ to $10^6$.

11. The lithographic printing plate of direct image type as claimed in claim 1, wherein the functional group-containing resin consists of a homopolymer or copolymer comprising the polar group-producing repeating units in a proportion of 1 to 95% by weight to the resin.

12. The lithographic printing plate of direct image type as claimed in claim 1, wherein the resin grains are obtained by any of dry process or wet process pulverization methods, polymer latex producing methods, dispersion methods, suspension polymerization methods and dispersion polymerization methods.

13. The lithographic printing plate of direct image type as claimed in claim 1, wherein said resin grains are partially crosslinked, and said crosslinking is carried out by incorporating functional groups capable of effecting a crosslinking reaction into a polymer containing functional groups capable of producing polar groups through decomposition and subjecting the polymer containing both the functional groups to crosslinking by the use of a crosslinking agent or hardening agent or by a high molecular reaction.

14. The lithographic printing plate of direct image type as claimed in claim 13, wherein the high molecular reaction is carried out in the presence of a multifunctional monomer or oligomer containing at least two polymerizable functional groups to form crosslinkings among the molecules.

15. The lithographic printing plate of direct image type as claimed in claim 1, wherein the matrix resin is at least one member selected from the group consisting of vinyl chloride/vinyl acetate copolymers, styrene/butadiene copolymers, styrene/methacrylate copolymers, methacrylate copolymers, acrylate copolymers, vinyl acetate copolymers, polyvinyl butyral, alkyd resins, silicone resins, epoxy resins, epoxy ester resins and polyester resins.

16. The lithographic printing plate of direct image type as claimed in claim 1, wherein the matrix resin is at least one member selected from the group consisting of polyvinyl alcohol, modified polyvinyl alcohol, starch, oxidized starch, carboxymethyl cellulose, hydroxyethyl cellulose, casein, gelatin, polyacrylates, polyvinylpyrrolidone, vinyl ether-maleic anhydride copolymers, polyamides and polyacrylamide.

* * * * *